US005487503A

United States Patent [19]

Sato et al.

[11] Patent Number: 5,487,503

[45] Date of Patent: Jan. 30, 1996

[54] WRAPPED ARTICLE WITH TEAR SLITS

[75] Inventors: Makoto Sato; Takayoshi Ose; Satoshi Aramaki, all of Kanagawa, Japan

[73] Assignee: Fuji Photo Film Co., Ltd., Kanagawa, Japan

[21] Appl. No.: 208,817

[22] Filed: Mar. 11, 1994

[30] Foreign Application Priority Data

| | | | |
|---|---|---|---|
| Mar. 12, 1993 | [JP] | Japan | 5-010749 U |
| Apr. 1, 1993 | [JP] | Japan | 5-016103 U |
| Apr. 1, 1993 | [JP] | Japan | 5-016106 U |
| Jun. 21, 1993 | [JP] | Japan | 5-033053 U |

[51] Int. Cl.[6] ..... B65D 65/30; B65D 85/677

[52] U.S. Cl. ..... 229/87.05; 206/387.1; 206/484; 383/200

[58] Field of Search ..... 229/87.05; 383/200; 206/484, 387

[56] References Cited

U.S. PATENT DOCUMENTS

| | | | |
|---|---|---|---|
| 2,053,116 | 9/1936 | Sperry | 383/200 X |
| 2,330,691 | 9/1943 | Darrow . | |
| 3,362,615 | 1/1968 | Rodda, Jr. | 229/87.05 |
| 3,485,345 | 12/1969 | Deasy | 229/87.05 |
| 4,726,473 | 2/1988 | Sato et al. . | |
| 5,129,518 | 7/1992 | Tanaka et al. | 206/484 X |

FOREIGN PATENT DOCUMENTS 2156767 10/1985 United Kingdom .

*Primary Examiner*—Bryon P. Gehman

*Attorney, Agent, or Firm*—Sughrue, Mion, Zinn, Macpeak & Seas

[57] ABSTRACT

The outer surface of an article is covered with a wrapping film, and the both edges of the film are lap-welded with each other to constitute a body seal section. A first slit is formed along the body seal section, substantially parallel thereto, and is spaced a small distance apart therefrom. A second slit is formed in the body seal section substantially at right angles or an inclined angle to the edge of the body seal section. When the end of the first slit is peeled off, the film splits along the body seal section and also towards the second slit. The second slit helps the split to stretch further in the transverse direction of the article. As a result of this, the wrapping film splits in both the longitudinal and lateral directions thereof.

17 Claims, 20 Drawing Sheets

FIG.42
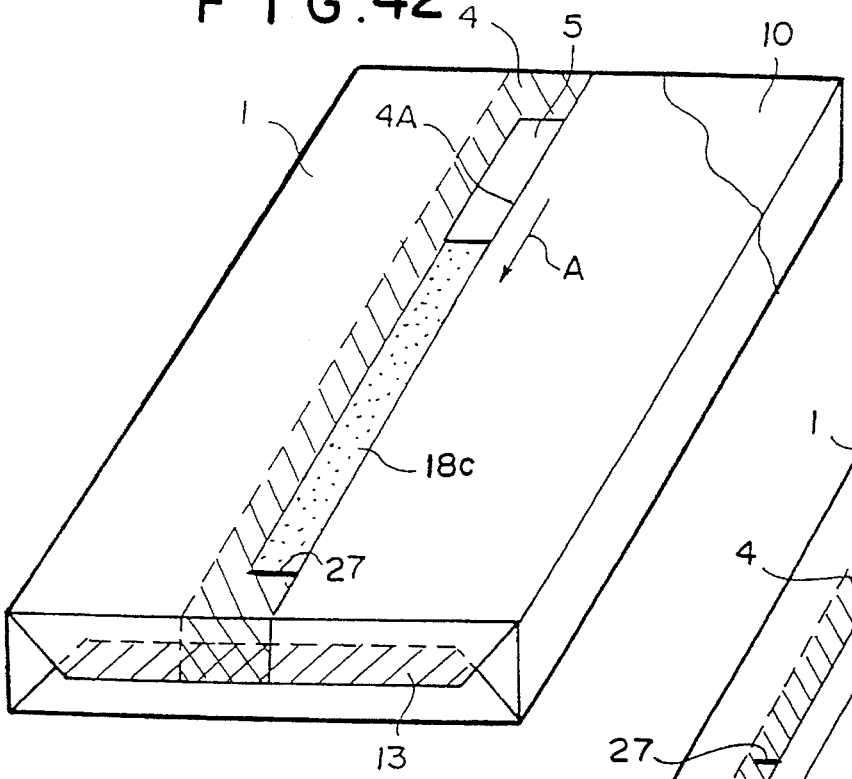
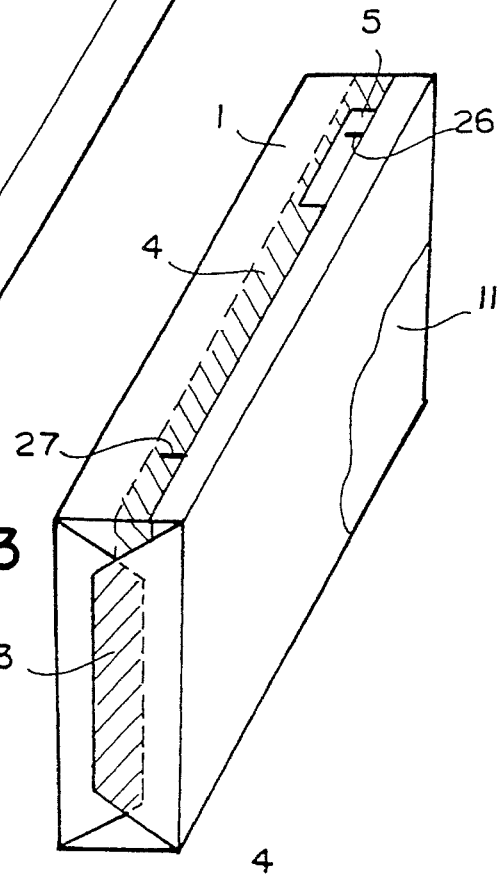
FIG.43
FIG.44
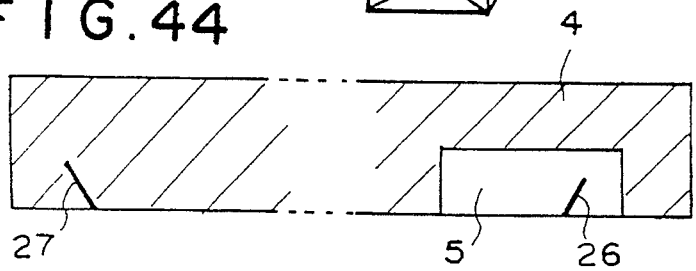
FIG.45
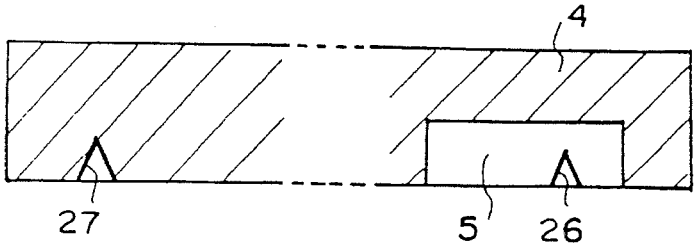

WRAPPED ARTICLE WITH TEAR SLITS

BACKGROUND OF THE INVENTION

1. Field of the Invention

This invention relates to an article wrapped with a wrapping film, and more particularly to a wrapped article in such a form that a wrapping film is attached in close contact with an object to be wrapped; for example, a wrapped article which contains one or a number of objects such as a magnetic tape cassette housed in a case.

2. Description of the Prior Art

Of various types of recent commodities arranged in a shop, in the case of relatively small products having a regular shape such as a magnetic tape cassette, the product is wrapped with a transparent or translucent wrapping film coated with cellophane, polyethylene, polypropylene, polyvinylchloride, polyvinylidenechloride, or the like, in order to protect the product from dust or moisture and so maintain a good appearance. These magnetic tape cassettes are shipped as a wrapped article or displayed at the shop as one of packages to be sold en block in which an appropriate number of goods are collectively packed.

As a matter of course, when an article (a product) wrapped in this type of wrapping film is used, it is necessary to remove this wrapping film. In most cases, as shown in FIG. 47, a tearing tape 2 is formed inside the wrapping film, and a constitution for facilitating the removal of the film from an article 10 is generally adopted.

In other words, this tearing tape 2 allows a wrapping film 1 to be appropriately split and separated by pulling an exposed end 2*a* of the tape 2. Slits 3 are formed along this tearing tape in the vicinity of the exposed end 2*a*, thereby facilitating the removal of the tape. With such a constitution, the wrapping film 1 can be split along the tearing tape 2 from the end 2*a*. As a result of this, the wrapping film 1 is split up completely or separated in two.

A wrapping method which is generally called shrink-wrap is widely used for such a wrapping film. In this shrink-wrap, when a wrapping film is attached to an article to be wrapped (i.e. a product), the product is enclosed in the wrapping film while the film is appropriately stretched or heated to a suitable temperature in accordance with material of the film. The wrapping film is tightly attached on to the product because of a contracting action of the film, so that the product is enclosed giving it a good appearance. Such tight attachment of the film to the wrapping film involves a laborious removal action to open the film. Conventionally, several measures are taken to overcome the drawback in the prior art by, for example, forming the tearing tape as mentioned above. This tearing tape was a very effective means.

However, in order to form a tearing tape inside a wrapping film, machines and processes which are dedicated to produce the tearing tape become necessary. In addition, in view of its function, the tearing tape must be sturdier than the wrapping film, and this tearing tape adds to the cost.

Moreover, although it depends on the position of the tearing tape, when the tearing tape is disposed as shown in FIG. 47, a smaller part "a" of the film remaining after the film has been split by the tearing tape is easy to remove. On the other hand, a larger remaining film involves a very laborious removal action in order to get at the actual contents.

SUMMARY OF THE INVENTION

In view of the foregoing descriptions and observations, the object of this invention is to provide a wrapped article which requires neither a special machine nor member and with which it is easy to remove the wrapper from the article by tearing the whole of the wrapping film.

Still another object of this invention is to provide a wrapped article which does not involve the complete separation of a wrapping film into two, as is required in opening the film by a conventional tearing tape, while the film is attached to an article to be wrapped; which eliminates the necessity to remove a remaining wrapping film as is required in the case of a conventional tearing tape; and which yields several advantages such as the removal of a process for forming a tearing tape from production processes and a reduction in material cost because the tearing tape becomes unnecessary.

To these ends, according to a first aspect of this invention, the present invention provides a wrapped article in which the outer surface of an article to be wrapped is covered with a wrapping film and a body seal section is made by making both ends of the wrapping film overlap with each other and bonding them together, the improvement comprising:

a first slit formed, substantially parallel to the edge of a lower film, on the edge of an upper film in the body seal section or at a position spaced away from the edge of the upper film; and at least one second slit formed on the periphery of the lower film at right angles or an inclined angle to the first slit in such a manner as to traverse the body seal section.

Here, the term "bonding" used in this specification comprises so-called welding, i.e., bonding by heating as well as adhesion with the use of an adhesive throughout the specification.

In the first wrapped article, the second slit may be formed in the vicinity of either end of the first slit substantially at right angles thereto, or two second slits may be formed and spaced apart from each other with the first slit interposed between them.

According to a second aspect of this invention, the present invention provides a wrapped article in which the outer surface of an article to be wrapped is covered with a wrapping film and a body seal section is formed by making both ends of the wrapping film overlap with each other and bonding them together while the longitudinal periphery of the body seal section closer to the edge of a lower film is kept unbonded, the improvement comprising:

a first slit formed substantially parallel to the edge of the lower film portion in the unbonded periphery of the body seal section; and at least one second slit formed on the periphery of the lower film portion in the bonded portion of the body seal section at right angles or an inclined angle to the first slit in such a manner as to traverse the body seal section.

In this second wrapped article, as with the first wrapped article, the second slit may be formed in the vicinity of either end of the first slit substantially at right angles thereto, or two second slits may be formed and spaced away from each other with the first slit interposed between them.

The first and second wrapped articles, according to this invention, are provided with the first and second slits. Hence, when the first slit is pulled off, the wrapping film is split along the part of the film where the film is a single layer and has a weak strength alongside of the body seal section where the film is a double layer and has a large strength, so that the wrapping film is split substantially in two towards both sides relative to the body seal section. When the split reaches to the second slit, the film is further split in a direction that crosses the body seal section. Thereby, the wrapping film opens wider, and the film can be removed in such a way that the article is substantially uncovered in an extremely easy manner.

According to a third aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film and does not transversely extend to the edge of the lower film;

a first slit formed in the unbonded part at right angles or an inclined angle to the edge of the unbonded part in such a manner as to transverse the unbonded part; and a second slit formed in the lower film in the body seal section, and having a slit starting portion extending to the inside of the body seal from an initial point, that is, an intersection between the edge of the lower film and an imaginary continuation from the first slit or a point spaced away from that intersection in a direction moving away from the first slit along the edge of the lower film and an extended portion that continuously extends from the slit starting portion in a direction moving away from the first slit, in which the second slit is formed in such a way that the slit starting portion and the extended portion extend away from each other in relation to the first slit.

According to a fourth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film and does not transversely extend to the edge of the lower film;

a first slit formed in the unbonded part at right angles or an inclined angle to the edge of the unbonded part in such a manner as to transverse the unbonded part; and a second slit formed in the lower film in the body seal section, and having a slit starting portion extending to the inside of the body seal from an initial point, that is, an intersection between the edge of the lower film and an imaginary continuation from the first slit or a point spaced away from that intersection in a direction moving away from the first slit along the edge of the lower film and an extended portion that continuously extends from the slit starting portion in a direction moving away from the first slit, in which the second slit is formed in such a way that the slit starting portion and the extended portion extend away from each other in relation to the first slit; wherein the article has at least two surfaces; the body seal section is formed substantially at the center of one of the surfaces of the article; the first slit is formed in the vicinity of the periphery of the body seal; and an extended portion of the second slit extends to the inside of that surface.

Here, the wrapped article having at least two surfaces is an article having at least one reference surface, for example, an article having more than two surfaces such as a rectangular parallelepiped, a cube, a cylinder, or a circular cone.

In the wrapped article according to the third and fourth aspects of this invention, the first slit may be provided with a mark to make the slit distinctive, and to indicate a peeling direction of the slit.

In the wrapped article according to the third and fourth aspects of this invention, the first slit is formed in the unbonded section, and the second slit is formed on the periphery of the lower film in the vicinity of the unbonded section. With such a constitution, when the first slit is peeled off, this slit reaches an intersection between the extended portion and the slit starting portion defined in the body seal section where the wrapping film is welded into a double layer and has a large strength. The split then reaches to the starting point of the second slit and then the terminal of the extended portion. The split reaching the second slit starts to stretch over the wrapping film in a direction which crosses the body seal section.

On the other hand, the extended portion of the second slit extends in a direction moving away from the first slit, and hence the split reaching the terminal point of the extended portion stretches over the wrapping film in a direction moving away from the first slit and the initial point. Thereby, the wrapping film opens wider after the body seal section has been split, and the film can be peeled off such that the article is substantially completely uncovered.

In the case of the article to be wrapped having at least two surfaces, the body seal section is formed substantially at the center of one of the surfaces, and the first slit is formed in the vicinity of the periphery of the body seal section. With such a constitution, a split from the first and second slits stretches in a direction opposite to the periphery of the body seal section where the first slit is formed, whereby the wrapping film opens much wider.

Moreover, the first slit should preferably be provided with a mark, and this makes it easy for a user to realize the position of the slit and a direction in which the slit is to be peeled off.

According to a fifth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film; and a slit formed at right angles or at an inclined angle to the edge of the upper film on the periphery of the upper film outside the unbonded part.

According to a sixth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film; and a slit formed at right angles or at an inclined angle to the edge of the upper film on the periphery of the upper film outside the unbonded part and-spaced a distance from the unbonded part.

According to a seventh aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part; and a second slit formed at right angles or at an inclined angle to the edge of the upper film on the periphery of the unbonded part.

According to an eighth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part and spaced a distance from the unbonded part; and a second slit formed at right angles or at an inclined angle to the edge of the upper film on the periphery of the unbonded part in the body seal section.

According to a ninth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part; and a second slit formed at right angles or at an inclined angle to the edge of the upper film outside the unbonded part in the body seal section on the side opposite to the first slit with the unbonded part interposed between them.

According to a tenth aspect of this invention, the present invention provides a wrapped article in which the outer surface of an article to be wrapped is covered with a wrapping film and a body seal is formed by making both ends of the wrapping film overlap with each other and welding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part and spaced a distance from the unbonded part; and a second slit formed at right angles or at an inclined angle to the edge of the upper film outside the unbonded part in the body seal section on the side opposite to the first slit with the unbonded part interposed between them.

According to an eleventh aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part; and a second slit formed at right angles or at an inclined angle to the edge of the upper film outside the unbonded part in the body seal section at a position, where the first slit and the second slit are arranged symmetrical about the unbonded part, on the side opposite to the first slit with the unbonded part interposed between them.

According to a twelfth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part and spaced a distance from the unbonded part; and a second slit formed at right angles or at an inclined angle to the edge of the upper film outside the unbonded part in the body seal section at a position, where the first slit and the second slit are arranged symmetrical about the unbonded part, on the side opposite to the first slit with the unbonded part interposed between them.

According to a thirteenth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a slit formed at right angles or at an inclined angle to the edge of the upper film on the periphery of the upper film outside the unbonded part; and a weakly bonded part which is weakly bonded to the periphery of the lower film and extends from the slit-side end of the unbonded part to the slit along the edge of the upper film.

According to a fourteenth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a slit formed at right angles or at an inclined angle to the edge of the upper film on the periphery of the upper film outside the unbonded part and spaced a distance from the unbonded part; and a weakly bonded part which is weakly bonded to the periphery of the lower film and extends from the slit-side end of the unbonded part to the slit along the edge of the upper film.

According to a fifteenth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part;

a second slit formed at right angles or at an inclined angle to the edge of the upper film on the periphery of the unbonded part; and a weakly bonded part which is weakly bonded to the periphery of the lower film and extends from the first-slit-side end of the unbonded part to the first slit along the edge of the upper film.

According to a sixteenth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part and spaced a distance from the unbonded part;

a second slit formed at right angles or at an inclined angle to the edge of the upper film on the periphery of the unbonded part in the body seal section; and a weakly bonded part which is weakly bonded to the periphery of the lower film and extends from the first-slit-side end of the unbonded part to the first slit along the edge of the upper film.

According to a seventeenth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part;

a second slit formed at right angles or at an inclined angle to the edge of the upper film outside the unbonded part in the body seal section on the side opposite to the first slit with the unbonded part interposed between them; and a weakly bonded parts which is weakly bonded to the periphery of the lower film and extends from the first-slit-side end of the unbonded part to the first slit along the edge of the upper film.

According to an eighteenth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part and spaced a distance from the unbonded part;

a second slit formed at right angles or at an inclined angle to the edge of the upper film outside the unbonded part in the body seal section on the side opposite to the first slit with the unbonded part interposed between them; and a weakly bonded part which is weakly bonded to the periphery of the lower film and extends from the first-slit-side end of the unbonded part to the first slit along the edge of the upper film.

According to a nineteenth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part;

a second slit formed at right angles or at an inclined angle to the edge of the upper film outside the unbonded part in the body seal section at a position, where the first slit and the second slit are arranged symmetrical about the unbonded part, on the side opposite to the first slit with the unbonded part interposed between them; and a weakly bonded part which is weakly bonded to the periphery of the lower film and extends from the first-slit-side end of the unbonded part to the first slit along the edge of the upper film.

According to a twentieth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part and spaced a distance from the unbonded part;

a second slit formed at right angles or at an inclined angle to the edge of the upper film outside the unbonded part in the body seal section at a position, where the first slit and the second slit are arranged symmetrical about the unbonded part, on the side opposite to the first slit with the unbonded part interposed between them; and a weakly bonded part which is weakly bonded to the periphery of the lower film and extends from the first-slit-side end of the unbonded part to the first slit along the edge of the upper film.

According to a twenty-first aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part;

a second slit formed at right angles or at an inclined angle to the edge of the upper film on the periphery of the unbonded part;

a first weakly bonded part which is weakly bonded to the periphery of the lower film and extends from the first-slit-side end of the unbonded part to the first slit along the edge of the upper film; and a second weakly bonded part which is weakly bonded to the periphery of the lower film and extends from the second-slit-side end of the unbonded part to the second slit along the edge of the upper film.

According to a twenty-second aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part and spaced a distance from the unbonded part;

a second slit formed at right angles or at an inclined angle to the edge of the upper film on the periphery of the unbonded part in the body seal section;

a first weakly bonded part which is weakly bonded to the periphery of the lower film and extends from the first-slit-side end of the unbonded part to the first slit along the edge of the upper film; and a second weakly bonded part which is weakly bonded to the periphery of the lower film and extends from the second-slit-side end of the unbonded part to the second slit along the edge of the upper film.

According to a twenty-third aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part;

a second slit formed at right angles or at an inclined angle to the edge of the upper film outside the unbonded part in the body seal section on the side opposite to the first slit with the unbonded part interposed between them;

a first weakly bonded part which is weakly bonded to the periphery of the lower film and extends from the first-slit-side end of the unbonded part to the first slit along the edge of the upper film; and a second weakly bonded part which is weakly bonded to the periphery of the lower film and extends from the second-slit-side end of the unbonded part to the second slit along the edge of the upper film.

According to a twenty-fourth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part and spaced a distance from the unbonded part;

a second slit formed at right angles or at an inclined angle to the edge of the upper film outside the unbonded part in the body seal section on the side opposite to the first slit with the unbonded part interposed between them;

a first weakly bonded part which is weakly bonded to the periphery of the lower film and extends from the first-slit-side end of the unbonded part to the first slit along the edge of the upper film; and a second weakly bonded part which is weakly bonded to the periphery of the lower film and extends from the second-slit-side end of the unbonded part to the second slit along the edge of the upper film.

According to a twenty-fifth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part;

a second slit formed at right angles or at an inclined angle to the edge of the upper film outside the unbonded part in the body seal section at a position, where the first slit and the second slit are arranged symmetrical about the unbonded part, on the side opposite to the first slit with the unbonded part interposed between them;

a first weakly bonded part which is weakly bonded to the periphery of the lower film and extends from the first-slit-side end of the unbonded part to the first slit along the edge of the upper film; and a second weakly bonded part which is weakly bonded to the periphery of the lower film and extends from the second-slit-side end of the unbonded part to the second slit along the edge of the upper film.

According to a twenty-sixth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part and spaced a distance from the unbonded part;

a second slit formed at right angles or at an inclined angle to the edge of the upper film outside the unbonded part in the body seal section at a position, where the first slit and the second slit are arranged symmetrical about the unbonded part, on the side opposite to the first slit with the unbonded part interposed between them;

a first weakly bonded part which is weakly bonded to the periphery of the lower film and extends from the first-slit-side end of the unbonded part to the first slit along the edge of the upper film; and a second weakly bonded part which is weakly bonded to the periphery of the lower film and extends from the second-slit-side end of the unbonded part to the second slit along the edge of the upper film.

According to a twenty-seventh aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part;

a second slit formed at right angles or at an inclined angle to the edge of the upper film on the periphery of the unbonded part;

a first weakly bonded part which is weakly bonded to the periphery of the lower film and extends from the first-slit-side end of the unbonded part to the first slit along the edge of the upper film; and a second weakly bonded part which is weakly bonded to the periphery of the lower film and extends from the second-slit-side end of the unbonded part to the second slit along the edge of the upper film.

According to a twenty-eighth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part and spaced a distance from the unbonded part;

a second slit formed at right angles or at an inclined angle to the edge of the upper film on the periphery of the unbonded part in the body seal section;

a first weakly bonded part which is weakly bonded to the periphery of the lower film and extends from the first-slit-side end of the unbonded part to the first slit along the edge of the upper film; and a second weakly bonded part which is weakly bonded to the periphery of the lower film and extends from the second-slit-side end of the unbonded part to the second slit along the edge of the upper film.

According to a twenty-ninth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part;

a second slit formed at right angles or at an inclined angle to the edge of the upper film outside the unbonded part in the body seal section on the side opposite to the first slit with the unbonded part interposed between them;

a first weakly bonded parts which is weakly bonded to the periphery of the lower film and extends from the first-slit-side end of the unbonded part to the first slit along the edge of the upper film; and a second weakly bonded part which is weakly bonded to the periphery of the lower film and extends from the second-slit-side end of the unbonded part to the second slit along the edge of the upper film.

According to a thirtieth aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part and spaced a distance from the unbonded part;

a second slit formed at right angles or at an inclined angle to the edge of the upper film outside the unbonded part in the body seal section on the side opposite to the first slit with the unbonded part interposed between them;

a first weakly bonded part which is weakly bonded to the periphery of the lower film and extends from the first-slit-side end of the unbonded part to the first slit along the edge of the upper film; and a second weakly bonded part which is weakly bonded to the periphery of the lower film and extends from the second-slit-side end of the unbonded part to the second slit along the edge of the upper film.

According to a thirty-first aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part;

a second slit formed at right angles or at an inclined angle to the edge of the upper film outside the unbonded part in the body seal section at a position, where the first slit and the second slit are arranged symmetrical about the unbonded part, on the side opposite to the first slit with the unbonded part interposed between them;

a first weakly bonded part which is weakly bonded to the periphery of the lower film and extends from the first-slit-side end of the unbonded part to the first slit along the edge of the upper film; and a second weakly bonded part which is weakly bonded to the periphery of the lower film and extends from the second-slit-side end of the unbonded part to the second slit along the edge of the upper film.

According to a thirty-second aspect of this invention, the present invention provides a wrapped article in which the outer surface of an article to be wrapped is covered with a wrapping film and a body seal is formed by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film;

a first slit formed at right angles or at an inclined angle to the edge of the upper film on the periphery of the upper film outside the unbonded part and spaced a distance from the unbonded part;

a second slit formed at right angles or at an inclined angle to the edge of the upper film outside the unbonded part in the body seal section at a position, where the first slit and the second slit are arranged symmetrical about the unbonded part, on the side opposite to the first slit with the unbonded part interposed between them;

a first weakly bonded part which is weakly bonded to the periphery of the lower film and extends from the first-slit-side end of the unbonded part to the first slit along the edge of the upper film; and a second weakly bonded part which is weakly bonded to the periphery of the lower film and extends from the second-slit-side end of the unbonded part to the second slit along the edge of the upper film.

In the wrapped articles defined in the foregoing aspects, the unbonded part may be provided with a mark to make it distinctive. The unbonded part may also be provided with a mark to indicate a direction in which an object inserted into the unbonded part is moved to detach the upper film from the lower film.

The wrapped article may be provided with a mark to make the position of the first and second slits distinctive.

In the wrapped articles according to the foregoing aspects, a finger or a fingernail is inserted into the foregoing unbonded part, and this finger or the like is moved to the slit along the body seal section. Thereby, the end of the body seal section is peeled off, and the body seal is separated into the upper film and the lower film. The end of this upper film thus detached is pulled in a direction substantially at right angles to the body seal section, and the wrapping film is peeled off from the slit, and the split develops in a direction substantially at right angles to the body seal section. Thereby, the wrapping film opens widely, and the film can be peeled off such that the articled will be uncovered in a quite easy manner.

By forming the second slit, the wrapping film is split from the first and second slits, and this allows the film to be peeled off in such a way that the article is more easily uncovered substantially completely.

Also, by weakly bonding a part of the body seal between the unbonded part and the first slit and/or the second slit, the body seal section can be more easily peeled off, and hence the wrapping film can opens more easily.

It is more preferable that the wrapped article be provided with a mark to make the unbonded part, the first or second slit and a peeling direction distinctive, so that a position from which the wrapping film is peeled off becomes noticeable.

BRIEF DESCRIPTION OF THE DRAWINGS

FIG. 42 is a schematic representation of a wrapped article according to a fifteenth embodiment of this invention;

FIG. 43 is a schematic representation of a wrapped article according to a sixteenth embodiment of this invention;

FIG. 44 is a schematic representation showing another embodiment of the slit formed on the article in the tenth to the sixteenth embodiments of this invention;

FIG. 45 is a schematic representation showing still another embodiment of the slid formed on the article in the tenth to the sixteenth embodiments of this invention;

DETAILED DESCRIPTION OF THE EMBODIMENTS

With reference to the accompany drawings, preferred embodiments of this invention will now be described in detail.

First Embodiment

Figure 1A:
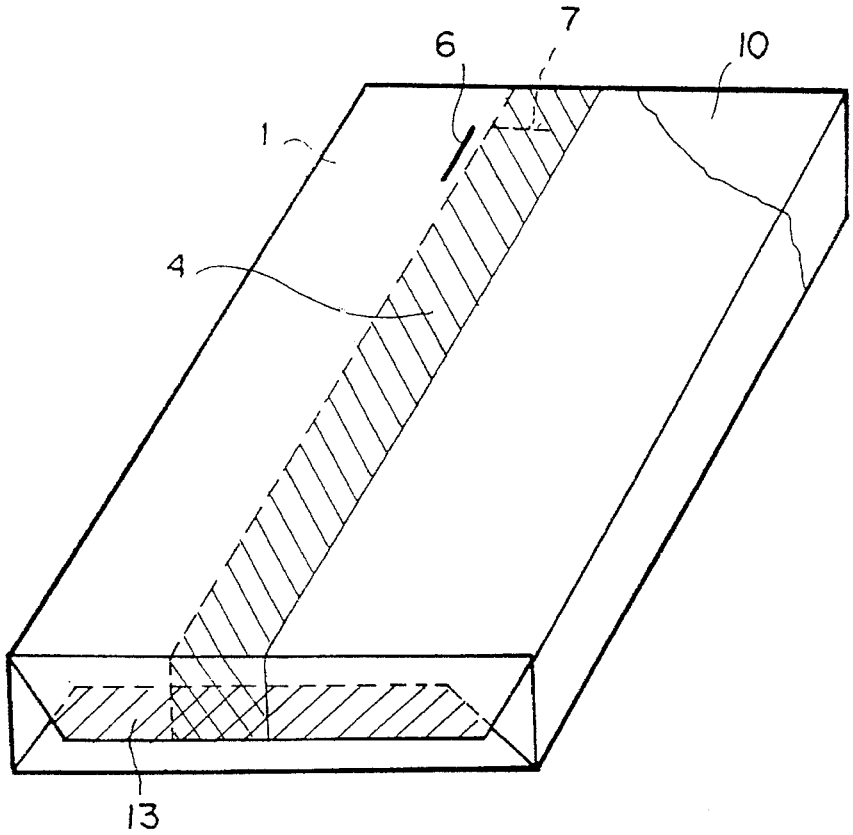
FIG. 1 (*a*) and (*b*) are schematic representations of a wrapped article according to a first embodiment of this invention.
Figure 2:
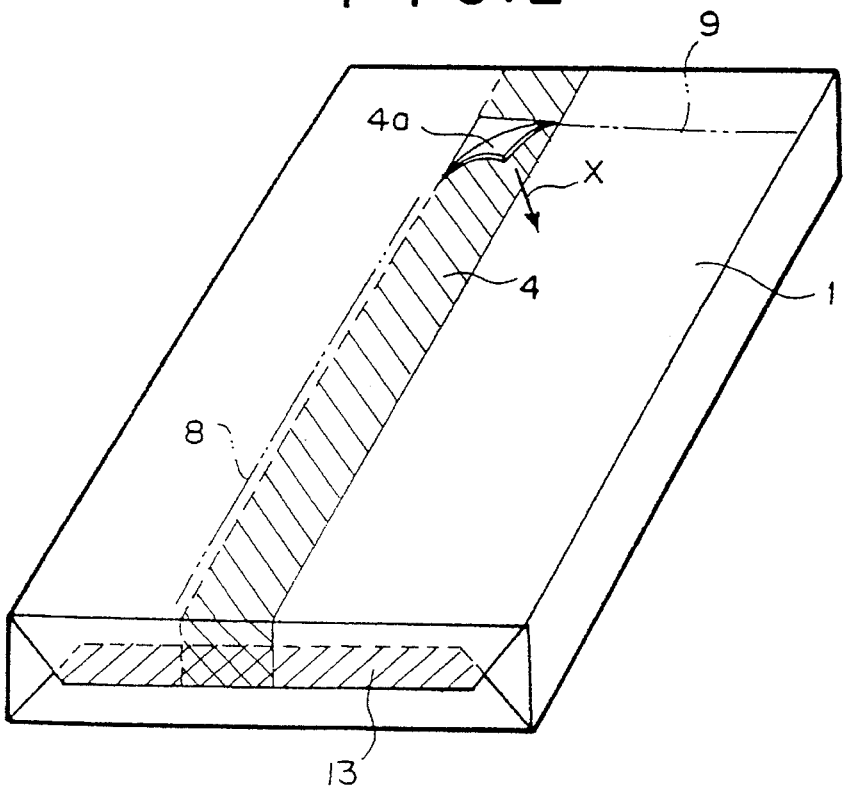
FIG. 2 is a schematic representation of the wrapped article shown in FIG. 1 when a first slit thereof is raised.
Figure 1B:
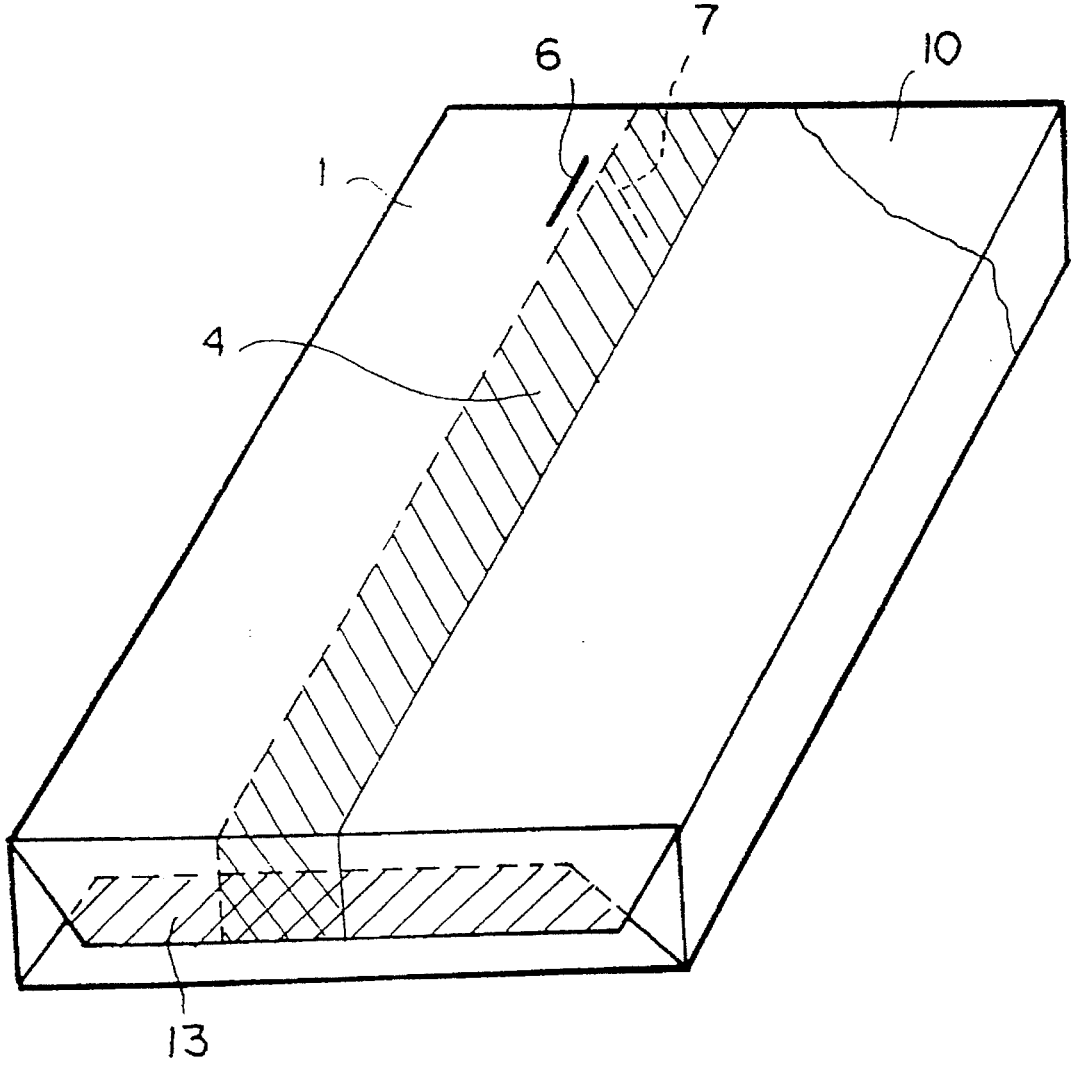

FIGS. 1 and 2 show a wrapped article according to a first embodiment of this invention, in which a video cassette is enclosed with a wrapping film.

As shown in FIGS. 1 and 2, opposite ends of a wrapping film overlap with each other substantially at the center of a surface of a parallelepiped-shaped article 10 to be wrapped (when it is contained in a housing case), that is, a video cassette. The overlapping portion of the film is heated and welded together to constitute a body seal section 4 (this body seal is represented by a slanting line throughout the drawings). Both ends of the body seal 4 are lap-welded together with the longitudinal edges of the wrapping film to constitute a side seal section 13.

The body seal section 4 and the side seal 13 where the ends of the film 1 overlap with each other are lap-welded together by appropriate heating or the like after the article 10 has been enclosed in the film.

Figure 3:
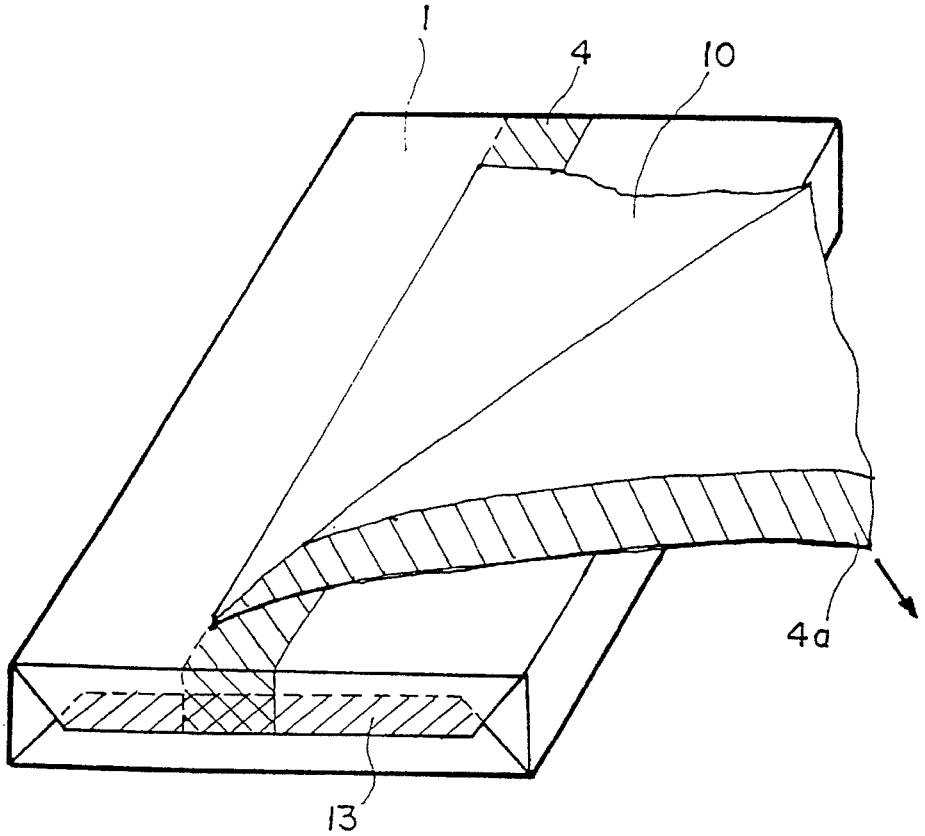
FIG. 3 is a schematic representation of the wrapped article shown in FIG. 1 when the first slit is further pulled.

A first slit 6 is formed along the body seal section 4 substantially parallel thereto and is spaced a small distance from the periphery of the body seal section. A second slit 7 is formed on the periphery of a lower film 7 in the body seal section 4 at right angles to the first slit 6 in such a manner as to traverse the body seal section. As shown in FIG. 2, the corner end **4*a* of the first slit 6 is peeled off in an X direction, the split of the first slit 6 is connected to a second slit 7. Then, the film splits along an imaginary line 8 where the film is a single layer and hence has a weak strength alongside of the body seal section 4 where the film 1 is welded into a double layer and hence has a large strength. As shown in FIG. 3, the film 1 splits substantially in two towards both sides from the body seal section 4. In addition to this, the split from the second slit 7 causes the wrapping film 1 to be removed along an imaginary line 9 substantially at right angles to the body seal section 4**.

On the other hand, the body seal section 4 is formed to extend substantially across the article 10 nearly at the center thereof in a longitudinal direction thereof, and this section finally reaches the side seal section 13. Because of this, the corner end **4*a* of the first slit 6 is peeled off when the film is opened, and the film 1 splits along the body seal section 4 where the film 1 is welded into a double layer and has a large strength, and hence the film is longitudinally split in two towards both sides. When the split reaches the side seal section 13 along the body seal section 4, the presence of the overlapping ends of the film 1 interrupts the further development of the split along the body seal section, and the split stretches in a transverse direction which crosses the body seal section 4**.

With the help of the split thus developing and another split developing from the second slit 7, it is possible to tear and open the wrapping film 1 toward both sides by a single removal action, that is, the peeling of the end 4*a*. Thus, the wrapping film 1 opens much wider. As a result of this, the wrapping film 1 is removed in such a way that one corner of the article 10 will be completely uncovered. The remaining piece of the film 1 (the film on the upper and left side of the first and second slits 6 and 7 in FIGS. 1 and 2) is still continued to the split film on the rear side of the article. Hence, this remaining film can be very easily removed by a successive operation, that is, by further peeling off the split film in a direction in which the film is taken away.

In the case of an existing wrapped article, it is relatively difficult for a user to remove a larger piece of film remaining after the film has been separated by the use of a tearing tape. Compared with this, the wrapped article of this invention enables a very effective removal operation, and also makes the use of the tearing tape unnecessary. This renders the wrapped article very cost effective.

Though this second slit 7 must be formed prior to packaging the article 10, the first slit 6 can be made after the article 10 has been packed. However, it is desirable for the first slit 6 to be made before packaging the article 10, thus removing the risk of damage to the article 10 by a cutting knife, etc.

Second Embodiment

Figure 4:
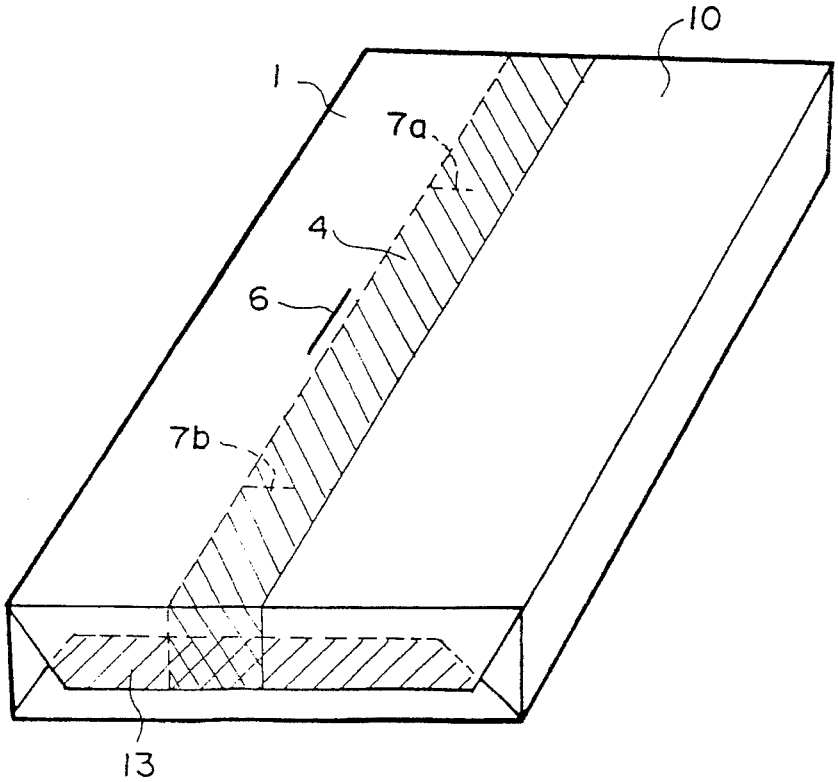
FIG. 4 is a schematic representation of a wrapped article according to a second embodiment of this invention.
Figure 5:
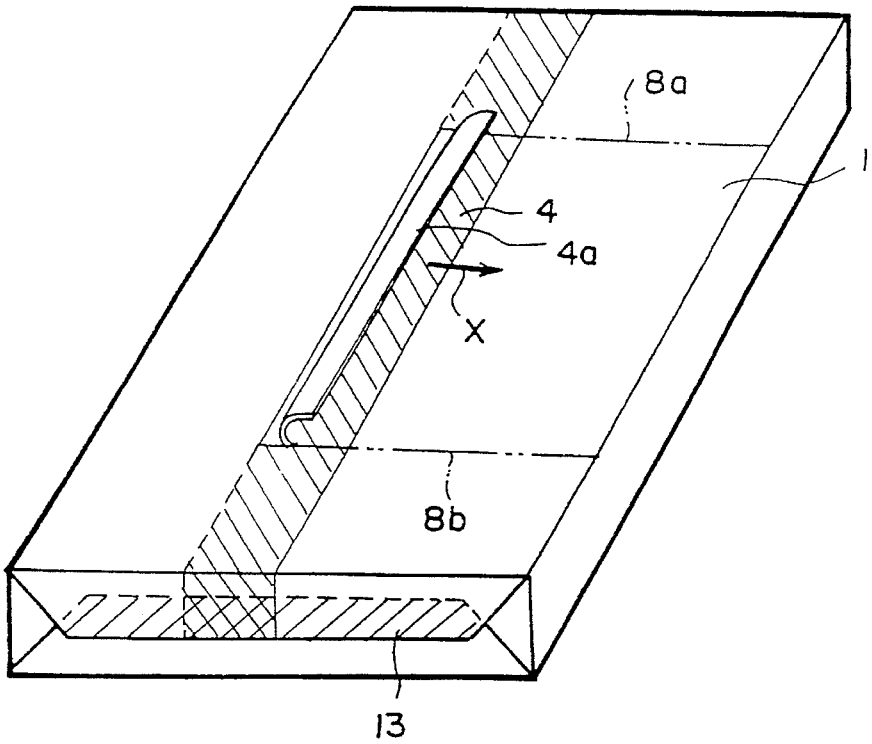
FIG. 5 is a schematic representation of the wrapped article shown in FIG. 4 when a first slit thereof is raised.

FIGS. 4 and 5 show a wrapped article according to a second embodiment of this invention. In the drawings, a wrapped state of the wrapping film 1 is the same as that in the foregoing first embodiment, and so detailed explanations thereof will be omitted.

As shown in FIG. 4, the first slit 6 is formed along the body seal section 4, substantially parallel thereto, and is spaced a small distance apart therefrom along the longitudinal periphery of the body seal section. Two second slits 7*a* and 7*b* are formed on the periphery of the lower film in the body seal section 4 at right angles to the first slit 6 in such a manner as to transverse the body seal section 4, and are spaced away from the first slit 6.

As shown in FIG. 5, when the end 4*a* of the first slit 6 is peeled off in an X direction, the film 1 splits over the part of the film where the film is single layer and has a weak strength alongside of the body seal section 4 where the film is welded into a double layer and has a large strength. When this film splits as far as the second slits 7*a* and 7*b*, the film 1 is then split further along imaginary lines 8*a* and 8*b* substantially at right angles to the body seal section 4 with the assistance of the second slits 7*a* and 7*b*. Thus, the film 1 opens much wider, and is removed in such a way that the body of the article 10 is completely uncovered. The split of the film continues around the article and returns to the body seal section 4, whereby the film 1 can be very easily removed by pulling the remaining area of the film (i.e., the area above and below the second slits 7*a* and 7*b*) to the outside.

Third Embodiment

Figure 6:
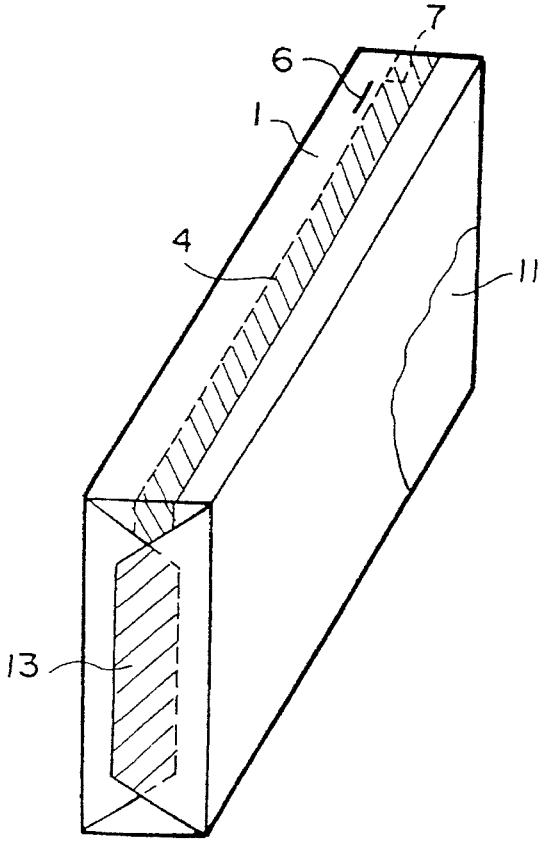
FIG. 6 is a schematic representation of a wrapped article according to a third embodiment of this invention.
Figure 7:
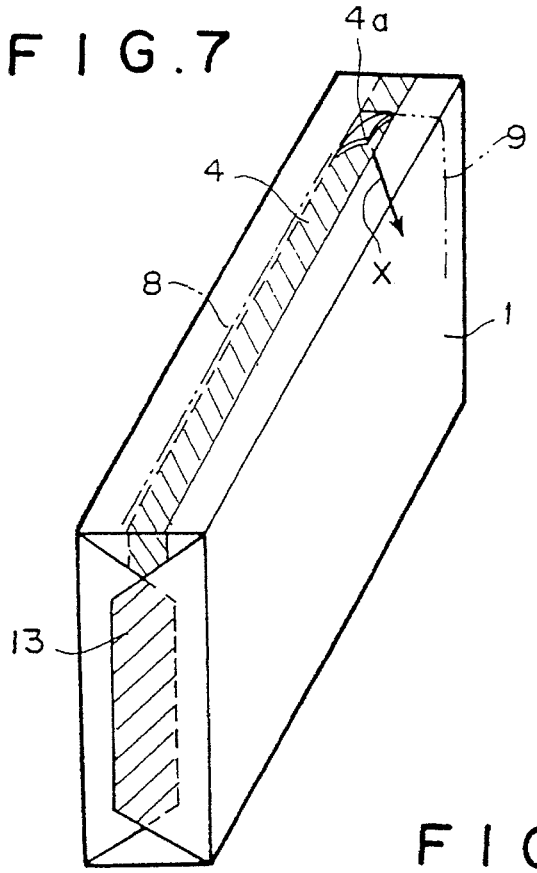
FIG. 7 is a schematic representation of the wrapped article shown in FIG. 6 when a first slit thereof is raised.

FIGS. 6 and 7 show a wrapped article according to a third embodiment of this invention, in which an audio cassette is enclosed, as an article to be wrapped, in a wrapping film. As shown in the drawings, both ends of the wrapping film 1 overlap with each other substantially at the center of a narrow lateral surface of an audio cassette 11 (the cassette is housed in a case) which serves as the article, and heated and lap-welded together to constitute the body seal section 4. Both ends of the body seal section 4 are lap-welded together with the longitudinal overlapping edges of the film 1, thereby constituting the side seal section 13. The first slit 6 is formed along the body seal section 4, substantially parallel thereto, and is spaced a small distance away therefrom on the longitudinal periphery of the body seal section. The second slit 7 is formed on the periphery of the lower film in the body seal section 4 at right angles to the first slit 6 in such a way as to transverse the body seal section 4.

Even in this case, no tearing tape is provided in the wrapping film 1. As shown in FIG. 7, the body seal section 4 splits by peeling off the end 4*a* of the first slit 6 in the X direction, and the film 1 splits along the imaginary line 8 over the entire length of the film in the same way as in the first embodiment. In addition to this, a split from the second slit 7 develops along the imaginary line 9 substantially at right angles to the body seal section 4, whereby the film 1 opens and is easily removed.

Fourth Embodiment

Figure 8:
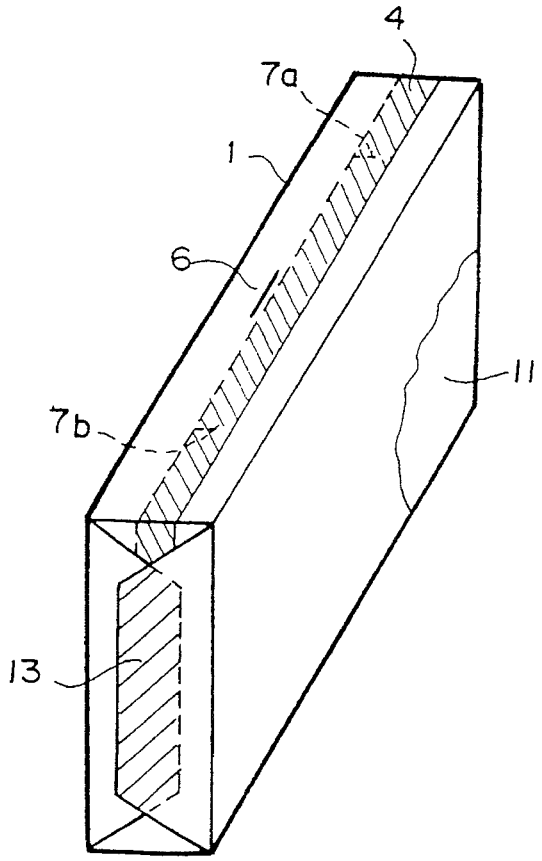
FIG. 8 is a schematic representation of a wrapped article according to a fourth embodiment of this invention.
Figure 9:
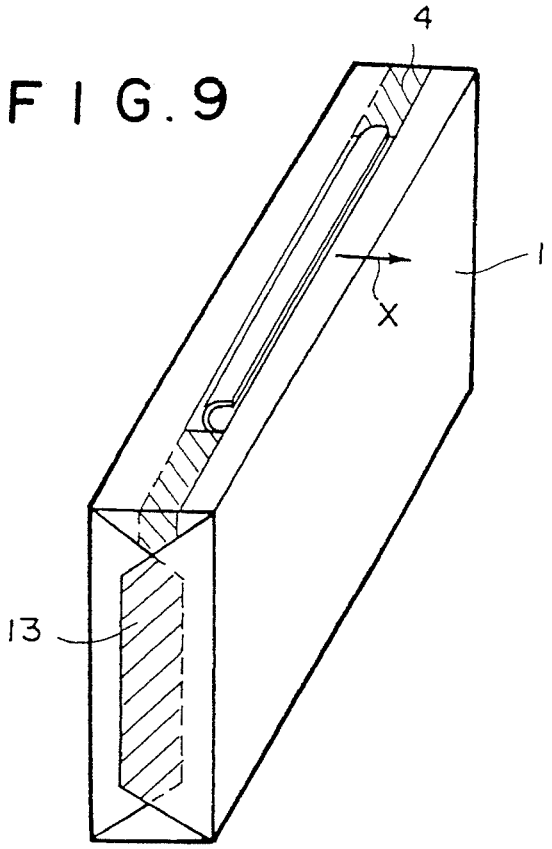
FIG. 9 is a schematic representation of the wrapped article shown in FIG. 8 when a first slit thereof is raised.

FIGS. 8 and 9 show a wrapped article according to a fourth embodiment of this invention, in which an audio cassette is enclosed, as an article to be wrapped, in a wrapping film. In this case, as with the second embodiment, the first slit 6 is formed along the body seal section 4, substantially parallel thereto, and is spaced a small distance away therefrom on the periphery of the body seal section 4. The two second slits 7*a* and 7*b* are formed on the periphery of the lower film 1 in the body seal section 4 at right angles to the first slit 6 in such a way as to transverse the body seal section 4, and are spaced away from the first slit 6.

In this embodiment, as shown in FIG. 9, when the end 4*a* of the first slit 6 is peeled off in the X direction, the film 1 is peeled off over a part of the film where the film is a single layer and has a weak strength alongside of the body seal section 4 where the film 1 is lap-welded into a double layer and has a large strength. When this film splits as far as the second slits 7*a* and 7*b*, the split further goes along the imaginary lines 8*a* and 8*b* substantially at right angles to the body seal section 4 owing to the second slits 7*a* and 7*b*. Thus, the film 1 opens much wider, and is removed in such a way that the body of the entire article 10 will be substantially uncovered. The split of the film continues around the article and returns to the body seal section 4, and the film 1 can be considerably easily removed by pulling the remaining piece of film (i.e., the area above and below the second slits 7*a* and 7*b*) to the outside.

In the first to the fourth embodiments set forth above, the position of the first slit 6 may be changed in accordance with a manner of welding the first slit. For instance, in a fifth embodiment shown in FIG. 10, both ends of the wrapping film 1 overlap with each other substantially at the center of a wide surface of the parallelepiped-shaped article 10. The overlapping edges of the film is partially lap-welded together to constitute a body seal section 4 while the remaining part of the overlapping edges that are closer to the edge of the lower part of the film are unbonded. In such a case, the first slit 6 should preferably be defined between the edge of the lower film and the bonded part.

Fifth Embodiment

Figure 10:
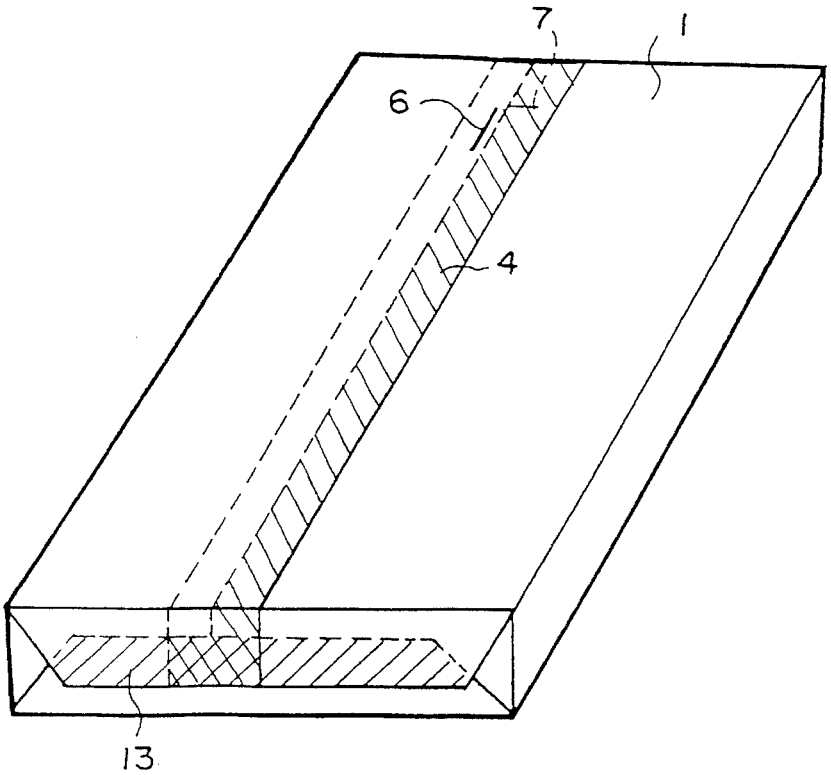
FIG. 10 is a schematic representation of a wrapped article according to a fifth embodiment of this invention.

In the case of the fifth embodiment shown in FIG. 10, when the first slit 6 is peeled off in the same manner as in the first embodiment, the film 1 splits along the body seal section 4, and a split from the second slit 7 runs in a direction which crosses the body seal section 4, whereby the wrapping film 1 can be considerably easily removed in the same way as in the first embodiment. Also, in this embodiment, it is difficult for dust and dirt, etc., to enter the film 1 from the first slit 6, and hence this embodiment is more preferable.

Sixth Embodiment

Figure 11:
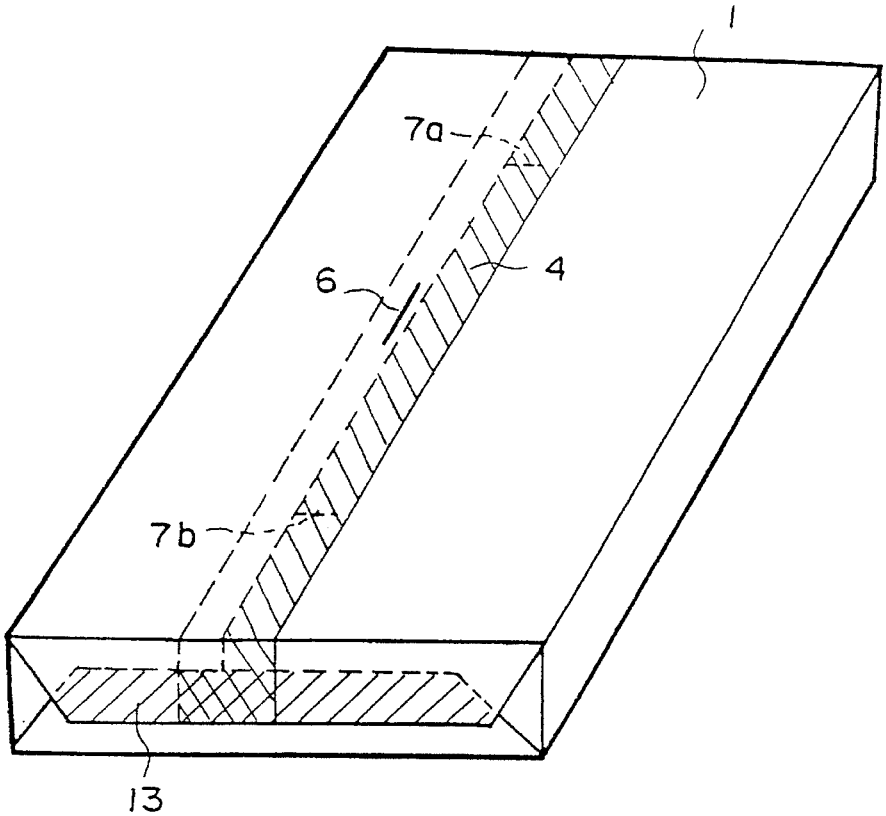
FIG. 11 is a schematic representation of a wrapped article according to a sixth embodiment of this invention.

FIG. 11 shows a sixth embodiment of this invention. Similarly to the fifth embodiment, when the two slits 7*a* and 7*b* are formed in the same manner as in the second embodiment, the wrapping film can be removed likewise.

Though the first slit is slightly spaced away from the edge of the body seal section as compared with the first to the fourth embodiments, this slit may be formed on the edge of the body seal section.

Figure 12:
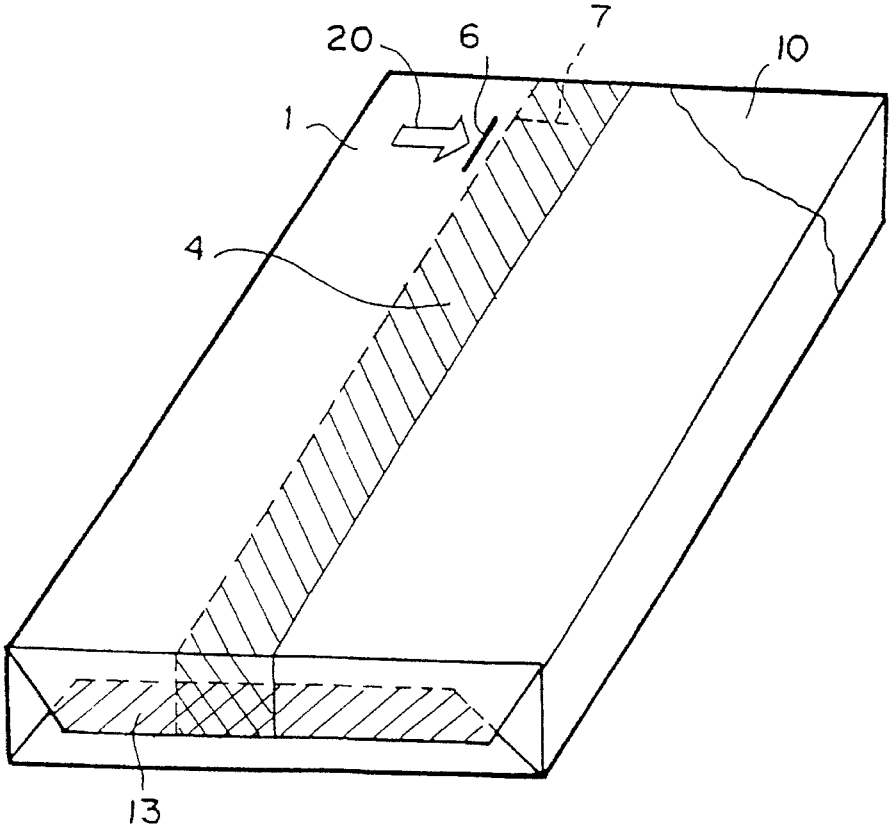
FIG. 12 is a schematic representation showing a wrapped article when a first slit thereof is provided with a mark.

In order to make the first slit distinctive, the wrapping film may be provided with a mark 20, for example, an arrow to indicate the position of the slit as shown in FIG. 12.

Figure 13:
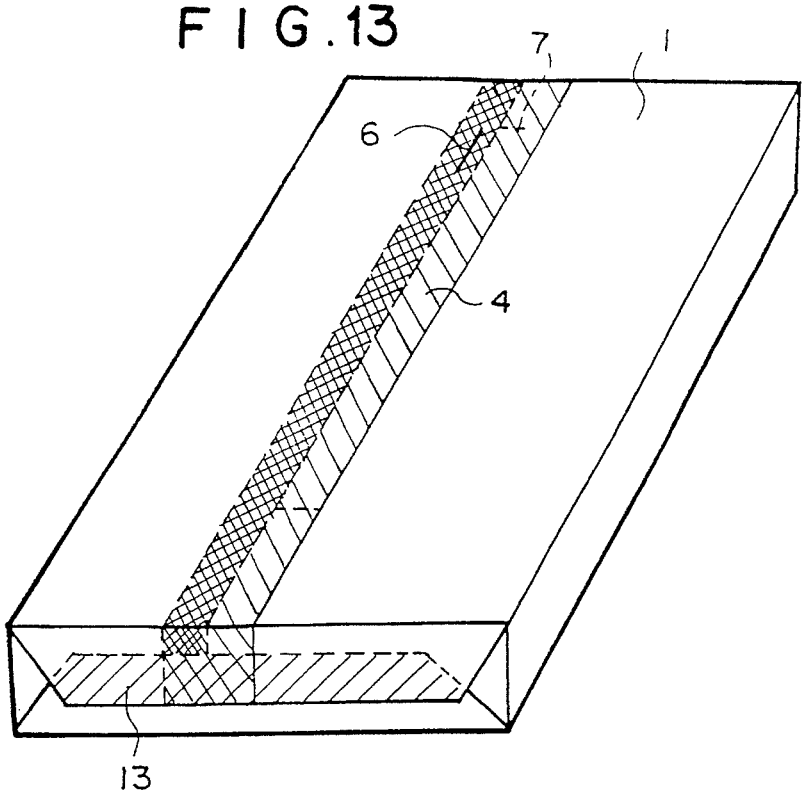
FIG. 13 is a schematic representation showing a wrapped article when the position of a first slit thereof is made distinctive.

In the fifth and sixth embodiments, the unbonded area in the body seal section may be made different in color from the bonded area in the same section so that the position of the first slit can become distinctive as shown in FIG. 13.

Figure 14:
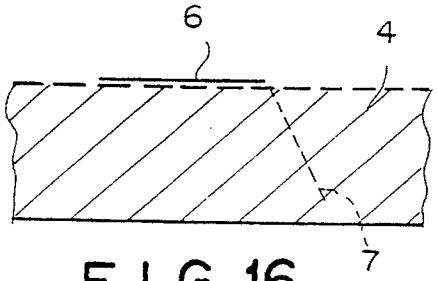
FIG. 14 is a schematic representation showing another embodiment of the first slit in the first to sixth embodiments of this invention.

In the first to the sixth embodiment, the second slit is made substantially at right angles to the first slit, however, the second slit 7 may be provided at an inclined angle to the first slit 6 as shown in FIG. 14.

Figure 15:
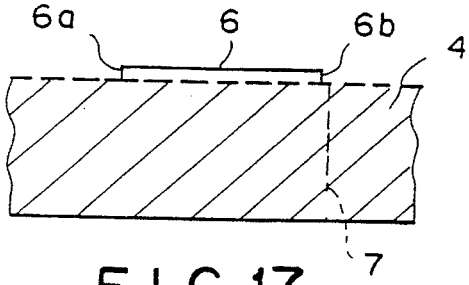
FIG. 15 is a schematic representation showing still another embodiment of the first slit in the first to sixth embodiments of this invention.
Figure 16:
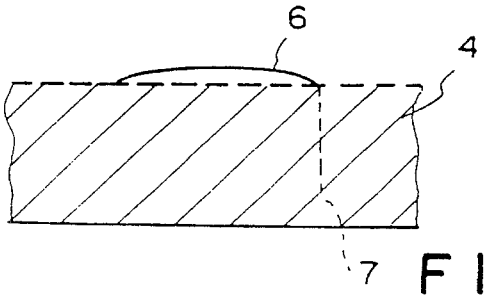
FIG. 16 is a schematic representation showing still another embodiment of the first slit in the first to sixth embodiments of this invention.
Figure 17:
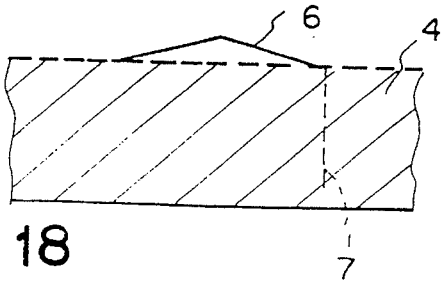
FIG. 17 is a schematic representation showing still another embodiment of the first slit in the first to sixth embodiments of this invention.
Figure 18:
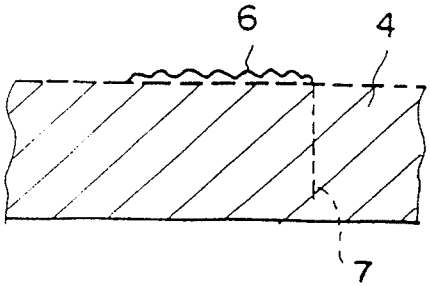
FIG. 18 is a schematic representation showing still another embodiment of the first slit in the first to sixth embodiments of this invention.

In the first to the sixth embodiments, the first slit is linearly formed. However, as shown in FIG. 15, small slits 6*a* and 6*b* may be formed on both ends of the first slit 6 substantially at right angles to the first slit, thereby facilitating the peeling of the first slit with fingers. In addition, the first slit may be formed into any one of an arc shape as shown in FIG. 16, a "V" shape as shown in FIG. 17 and a crimped shape as shown in FIG. 18. These shapes of the first slit can be applied to the fifth and sixth embodiments.

Other embodiments of this invention will now be described.

Seventh Embodiment

Figure 19:
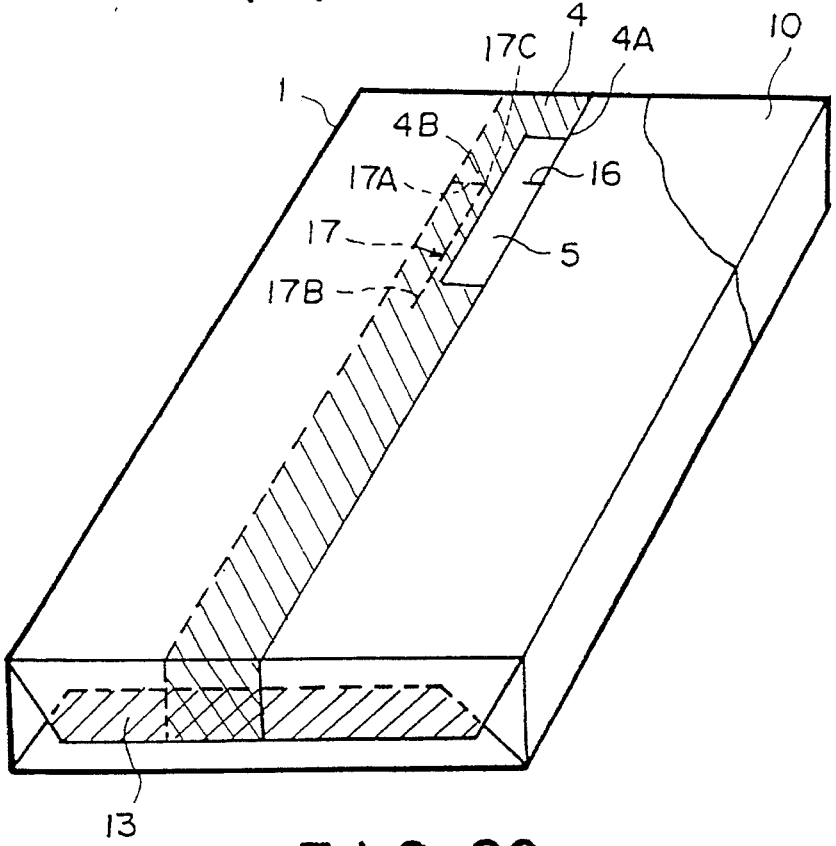
FIG. 19 is a schematic representation of a wrapped article according to a seventh embodiment of this invention.
Figure 20:
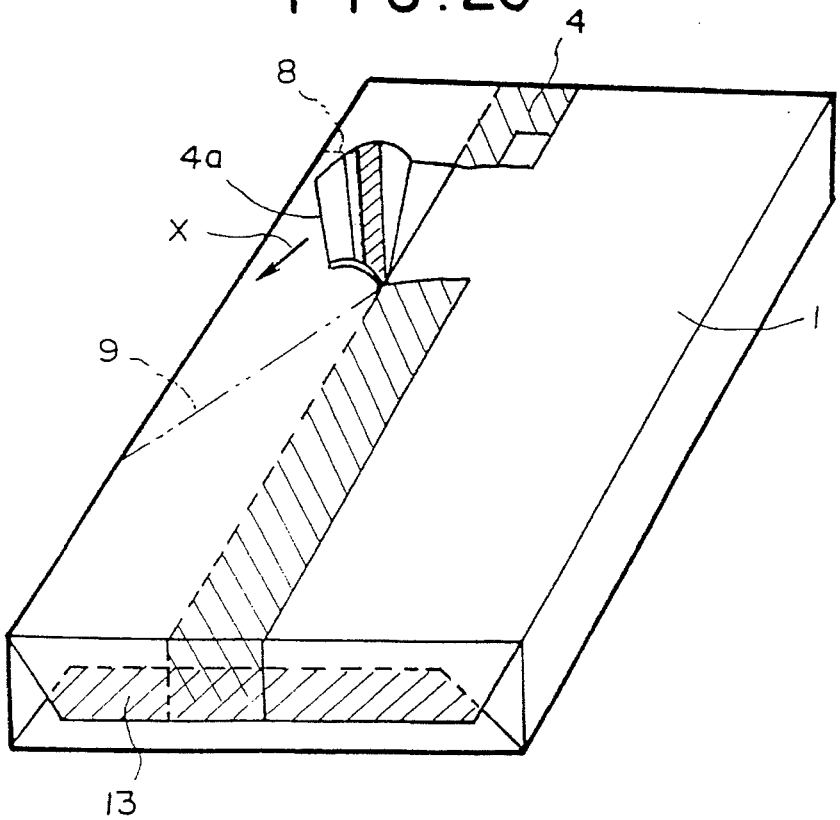
FIG. 20 is a schematic representation of the wrapped article shown in FIG. 19 when a first slit thereof is raised.

FIGS. 19 and 20 show a wrapped article according to a seventh embodiment of this invention, in which a video cassette is enclosed, as an article to be wrapped, in a wrapping film.

In the drawings, a wrapped state of the wrapping film 1 is the same as in the first to sixth embodiments, and hence detailed descriptions thereof will be omitted.

An unbonded part 5 is partially formed in the body seal section 4 along the edge of the upper film such that an area to be bonded 4B is left between the unbonded part and the edge of the lower film. A first slit 16 is formed in this unbonded part 5 at right angles to the end 4A of the upper film 1 in such a manner as to transverse the unbonded part. In the area 4B on the lower film, a slit starting portion 17A extends to the inside of the body seal section 4 from an initial point, that is, an intersection between the edge of the lower film 1 and an imaginary continuation from the first slit 16. Also, in the area 4B, an extended portion 17B continuously extends from the starting portion 17A in a direction moving away from the first slit 16. Thus, a second slit 17 is substantially L-shaped in such a way that the starting portion 17A and the extended portion 17B extend away from each other relative to the first slit 16.

When the end 4*a* of the first slit 16 is peeled off in the X direction as shown in FIG. 20, the unbonded part 5 is initially split toward the edge of the body seal section 4, and a part of the body seal section 4 sandwiched between the unbonded part 5 and the extended portion 17B of the second slit 17 then splits. The split reaches an intersection 17C between the starting portion 17A and the extended portion 17B of the second slit 17, and is connected to the second slit. The split reaching the intersection 17C further goes along the starting portion 17A and the extended position 17B, respectively.

Figure 21:
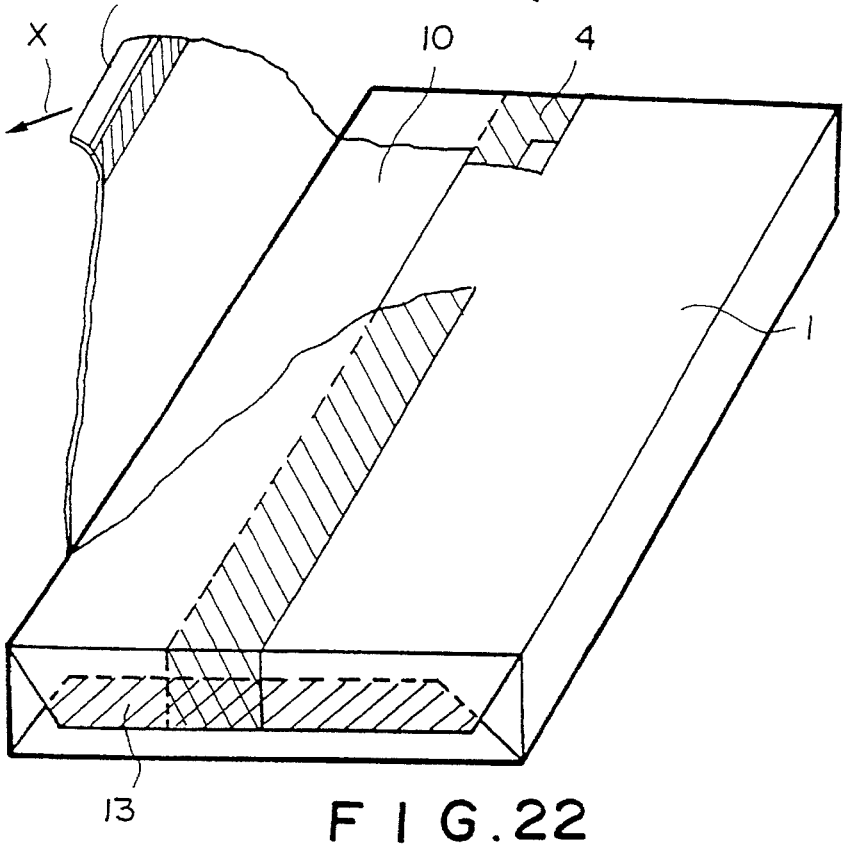
FIG. 21 is a schematic representation of the wrapped article shown in FIG. 19 when the first slit thereof is further pulled.

When the split going along the starting portion 17A reaches the initial point of the second slit, the split runs over the wrapping film along the imaginary line 8 in a direction which crosses the body seal section. On the other hand, the other split reaching the terminal point of the extended portion 17B of the second slit 17 runs further over the wrapping film 1 along the imaginary line 9 in a direction moving away from the first slit 16, because the extended portion 17B stretches in a direction moving away from the first slit 16. Finally, the wrapping film 1 opens much wider as shown in FIG. 21.

The split formed by such a tearing action can continue around the article by a single operation, that is, by peeling off the end 4*a* of the first slit, whereby the film opens much wider. In addition, the split from the extended portion 17B goes in a direction moving away from the first slit 16 and reaches the side seal section 13 (a lower area of the wrapped article in the drawing), and this allows the user to easily remove the side seal section 13. Thereby, the film 1 can be removed in such a way that the entire article 10 will be substantially uncovered in a considerably easy manner.

The remaining piece of the film 1 (the film on the upper and left side of the first and second slits 16 and 17 in FIGS. 19 and 20) is still continued to the split film on the rear side of the article. Hence, this remaining film can be very easily removed by a successive operation, that is, by further peeling off the split film in a direction in which the film is taken away.

In the case of an existing wrapped article, it is relatively difficult for a user to remove a larger piece of film remaining after the film has been separated by the use of a tearing tape. Compared with this, the wrapped article of this invention enables a very effective removal operation, and also makes the use of the tearing tape unnecessary. This renders the wrapped article very cost effective.

Though this second slit 17 must be formed prior to packaging the article 10, the first slit 16 can be made after the article 10 has been packed. However, it is desirable for the first slit 16 to be made before packaging the article 10, thus removing the risk of damage to the article 10 by a cutting knife, etc.

Eighth Embodiment

Figure 22:
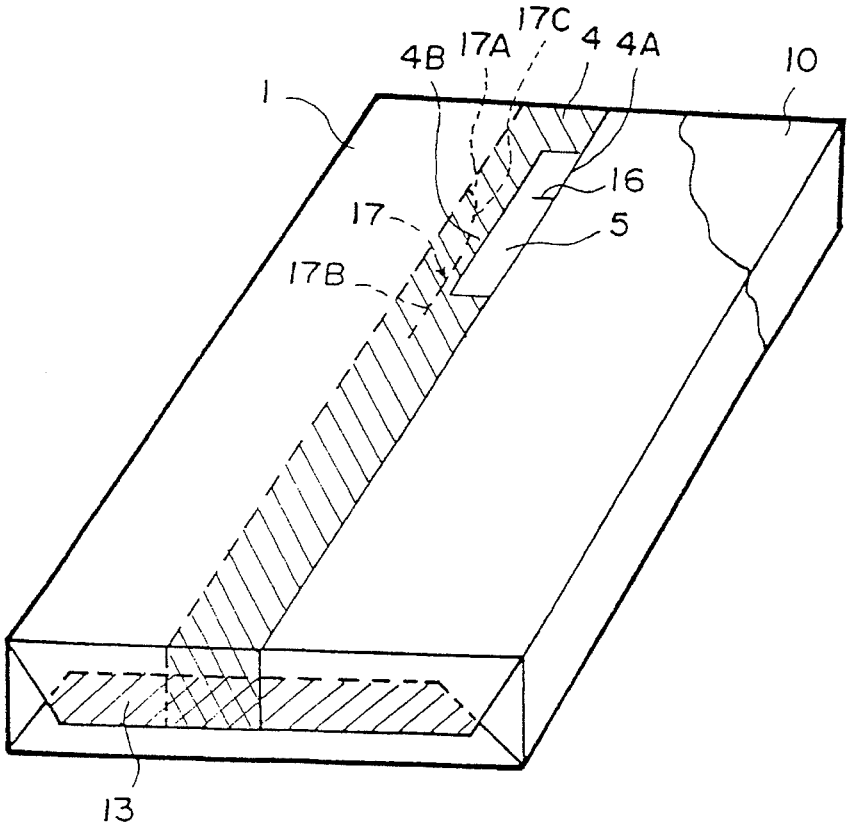
FIG. 22 is a schematic representation of a wrapped article according to an eighth embodiment of this invention.
Figure 23:
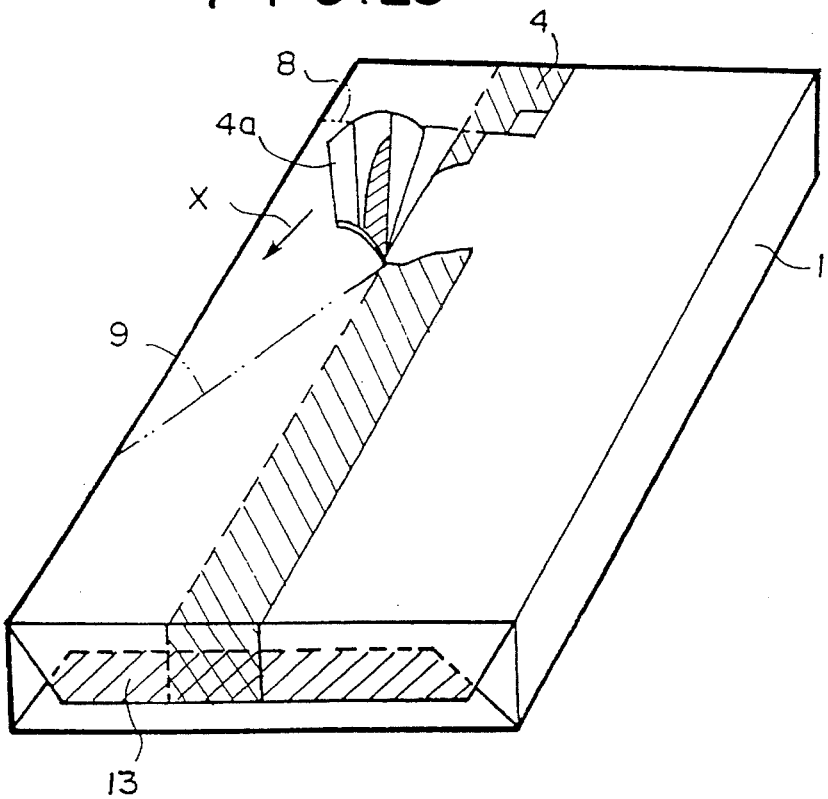
FIG. 23 is a schematic representation of the wrapped article shown in FIG. 22 when a first slit thereof is raised.

An eighth embodiment of this invention will now be described. FIGS. 22 and 23 show a wrapped article according to an eighth embodiment of this invention.

In the drawings, a wrapped state of the wrapping film 1, the unbonded part 5 and the first slit 16 are the same as in the seventh embodiment, and hence detailed descriptions thereof will be omitted. An explanation will only be given of the second slit 17.

As shown in FIG. 22, in the area to be bonded 4B of the lower film, the slit staring portion 17A extends to the inside of the body seal section 4 from an initial point, that is, an intersection between the edge of the lower film 1 and an imaginary continuation from the first slit 16. Also, in the area 4B, the extended portion 17B continuously extends from the starting portion 17A in a direction moving away from the first slit 16. Thus, the second slit 17 is formed into substantially an arc shape in such a way that the starting portion 17A and the extended portion 17B extend away from each other relative to the first slit 16.

When the end **4*a* of the first slit 16 is peeled off in the X direction as shown in FIG. 23, the unbonded part 5 is initially split toward the edge of the body seal section 4, and a part of the body seal section 4 sandwiched between the unbonded part 5 and the extended portion 17B of the second slit 17 then splits. The split reaches the intersection 17C between the starting portion 17A and the extended portion 17B of the second slit 17, and is connected to the second slit. The split reaching the intersection 17C further goes along the starting portion 17A and the extended portion 17B**, respectively.

When the split going along the starting portion 17A reaches the initial point of the second slit, the split runs over the wrapping film along the imaginary line 8 in a direction which crosses the body seal section. On the other hand, the other split reaching the terminal point of the extended portion 17B of the second slit 17 runs further over the wrapping film 1 along the imaginary line 9 in a direction moving away from the first slit 16, because the extended portion 17B stretches in a direction moving away from the first slit 16. Finally, the wrapping film 1 opens much wider in the same way as in the seventh embodiment.

The split formed by such a tearing action can continue around the article by a single operation, that is, by peeling off the end **4*a* of the first slit, whereby the film opens much wider. In addition, the split from the extended portion 17B goes in a direction moving away from the first slit 16 and reaches the side seal section 13 (a lower area of the wrapped article in the drawing), and this allows the user to easily remove the side seal section 13. Thereby, the film 1 can be removed in such a way that the entire article 10** will be substantially uncovered in a considerably easy manner.

The remaining piece of the film 1 (the film on the upper and left side of the first and second slits 16 and 17 in FIGS. 22 and 23) is still continued to the split film on the rear side of the article. Hence, this remaining film can be very easily removed by a successive operation, that is, by further peeling off the split film in a direction in which the film is taken away.

Ninth Embodiment

Figure 24:
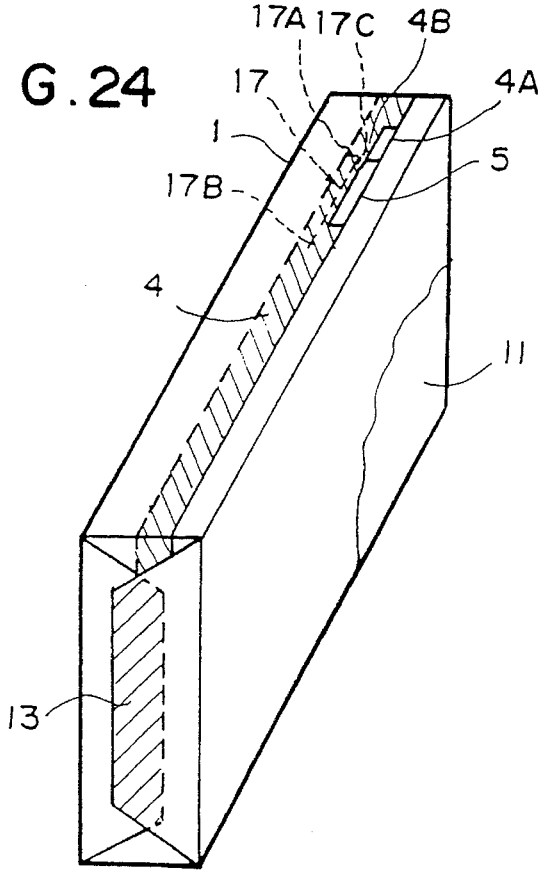
FIG. 24 is a schematic representation of a wrapped article according to a ninth embodiment of this invention.
Figure 25:
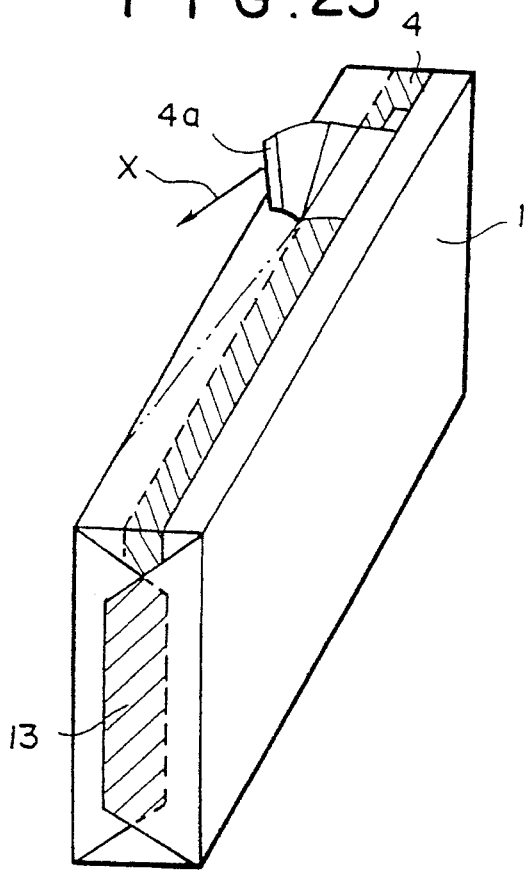
FIG. 25 is a schematic representation of the wrapped article shown in FIG. 24 when a first slit thereof is raised.

A ninth embodiment will now be described. FIGS. 24 and 25 show a wrapped article according to a ninth embodiment of this invention, in which an audio cassette is enclosed, as an article to be wrapped, in a wrapping film. As shown in the drawings, in the same way as in the third and fourth embodiments, both ends of the wrapping film 1 overlap with each other substantially at the center of a narrow lateral surface of an audio cassette 11 (the cassette is housed in a case) which serves as the article, and heated and lap-welded together to constitute the body seal section 4. Both ends of the body seal section 4 are lap-welded together with the longitudinal overlapping edges of the film 1, thereby constituting the side seal section 13. The unbonded part 5 is partially formed in the body seal section 4 along the edge of the upper film such that an area to be bonded 4B is left between the unbonded part and the edge of the lower film. The first slit 16 is formed in this unbonded part 5 at right angles to the edge 4A of the upper film 1 in such a manner as to transverse the unbonded part. In the area 4B on the lower film, the slit starting portion 17A extends to the inside of the body seal section 4 from an initial point, that is, an intersection between the edge of the lower film 1 and an imaginary continuation from the first slit 16. Also, in the area 4B, the extended portion 17B continuously extends from the starting portion 17A in a direction moving away from the first slit 16. Thus, the second slit 17 is substantially L-shaped in such a way that the starting portion 17A and the extended portion 17B extend away from each other relative to the first slit 16.

Even in this case, no tearing tape is provided in the wrapping film 1. As shown in FIG. 25, the body seal section 4 splits by peeling off the end **4*a* of the first slit 6 in the X direction, and the film 1 splits along the imaginary lines 8 and 9 over the entire length of the film in the same way as in the seventh and eighth embodiments set forth above, whereby the film 1** opends and is removed easily.

In this embodiment, as with the eighth embodiment, the second slit may be formed into an arc shape by connecting the slit starting portion 17A with the extended portion 17B in the form of an arc.

Figure 26:
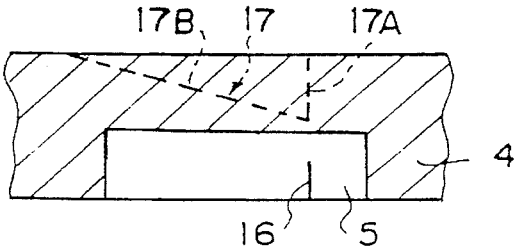
FIG. 26 is a schematic representation showing another embodiment of a second slit in the seventh to the ninth embodiments of this invention.

In the seventh to the ninth embodiments, the second slit is substantially L-shaped or formed into an arc shape, this slit is not limited to these shapes. So long as the second slit is formed in such a way that the starting portion 17A and the extended portion 17B extend away from each other in relation to the first slit 16, the second slit may be formed into any shape. For instance, as shown in FIG. 26, the second slit 17 may be formed so that an angle defined between the starting portion 17A and the extended portion 17B becomes acute.

Figure 27:
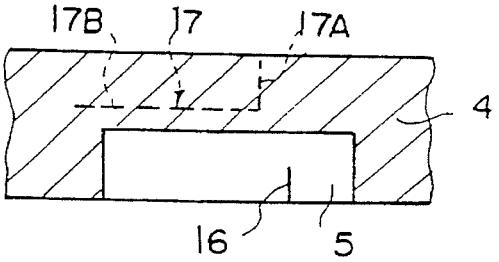
FIG. 27 is a schematic representation showing another embodiment of the position of the first slit in the seventh to the ninth embodiments of this invention.

In the seventh to the ninth embodiments, the initial point of the second slit is defined by the intersection between the imaginary continuation from the first slit and the edge of the lower film. However, as shown in FIG. 27, the initial point may be defined at a position spaced a distance away from that intersection along the edge of the lower film relative to the first slit 16.

Figure 28:
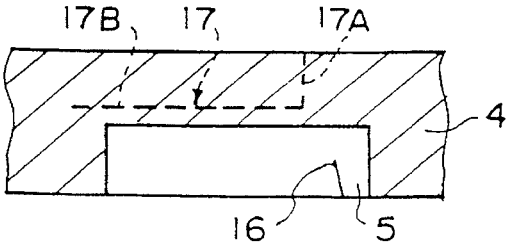
FIG. 28 is a schematic representation showing another embodiment of the first slit in the seventh to the ninth embodiments of this invention.

In the seventh to the ninth embodiments, the first slit is formed substantially at right angles to the edge of the body seal section. However, this first slit 16 may be formed at an inclined angle to the edge of the body seal section 4 as shown in FIG. 28.

Figure 29:
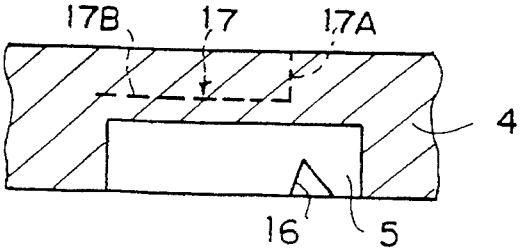
FIG. 29 is a schematic representation showing still another embodiment of the first slit in the seventh to the ninth embodiments of this invention.
Figure 30:
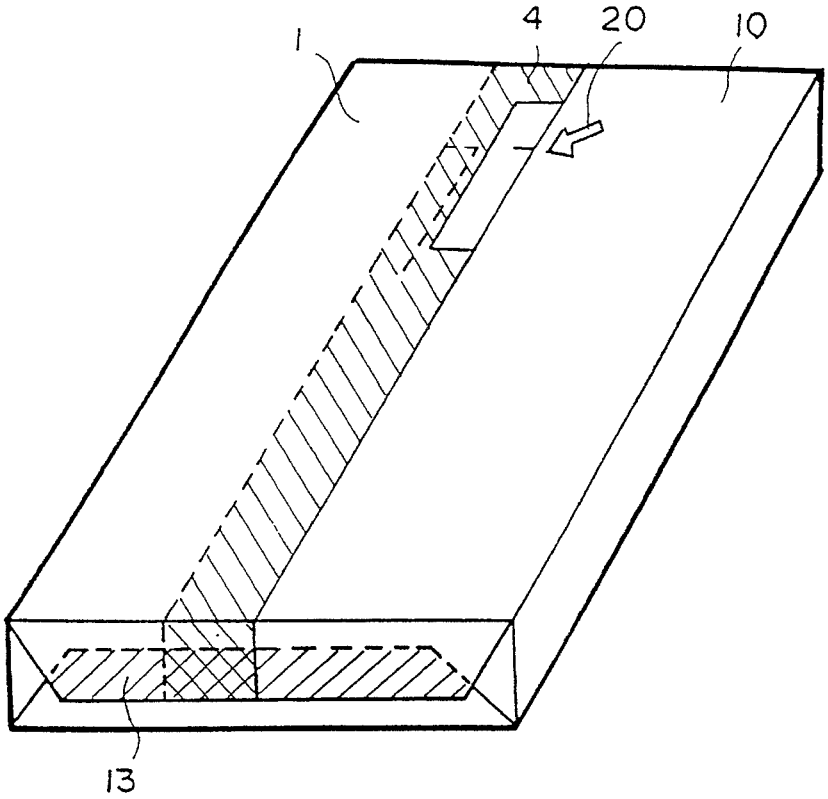
FIG. 30 is a schematic representation showing a wrapped article when a first slit thereof is provided with a mark.

In the seventh to the ninth embodiments, the first slit is linearly formed. However, as shown in FIG. 29, this slit may be V-shaped, thereby facilitating the peeling of the first slit 16 with fingers.

Moreover, in order to make the position of the first slit and a peeling direction thereof distinctive, the wrapping film may be provided with the mark 20, for example, the arrow to indicate the position of the first slit.

In the seventh to the ninth embodiments, parallelepiped-shaped articles such as the video cassette and the audio cassette are used as the article to be wrapped. However, the article is not limited to them. The article according to this invention can be applied to articles in any shapes such as a sphere, a rectangular parallelepiped, a cylinder, or a circular cone, so long as they can be enclosed with a wrapping film.

Still other embodiments will now be described.

Tenth Embodiment

Figure 31:
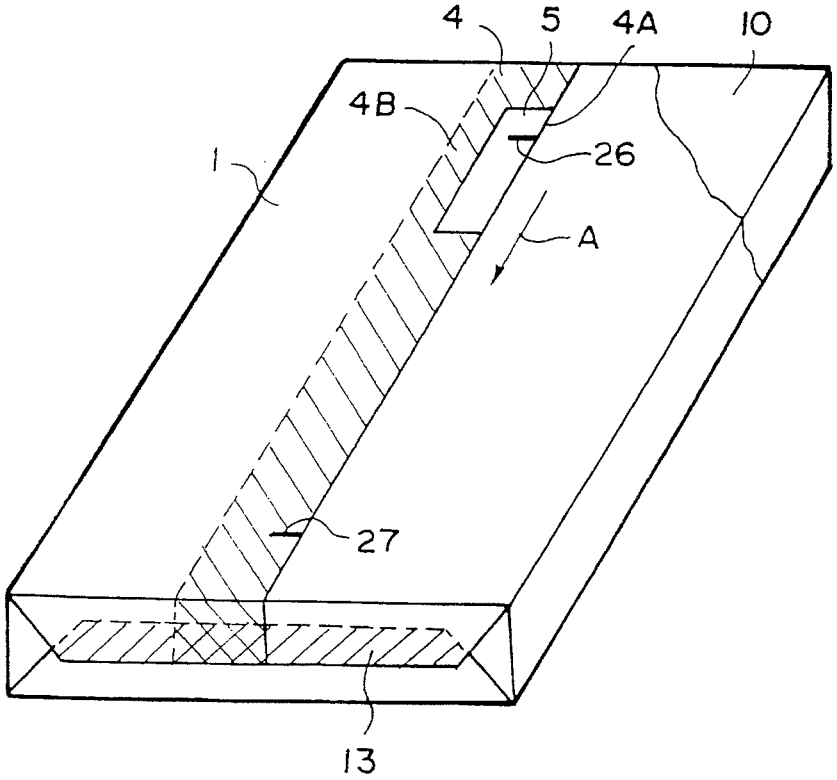
FIG. 31 is a schematic representation showing a wrapped article according to a tenth embodiment of this invention.
Figure 32:
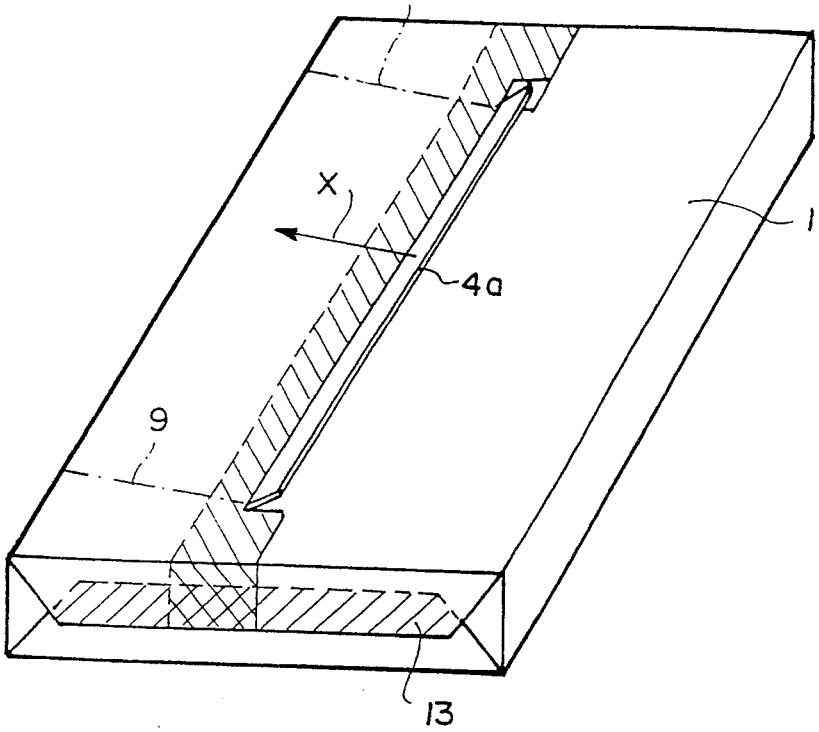
FIG. 32 is a schematic representation of the article shown in FIG. 31 when an upper film of a body seal thereof is raised.

FIGS. 31 and 32 show a wrapped article according to a tenth embodiment of this invention, in which a video cassette is enclosed, as an article to be wrapped, in a wrapping film. In the drawings, a wrapped state of the wrapping film 1 is the same as in the previous embodiments, and hence detailed descriptions thereof will be omitted.

The unbonded part 5 is partially formed in the body seal section 4 along the edge of the upper film such that an area to be bonded 4B is left between the unbonded part and the edge of the lower film. A first slit 26 is formed in this unbonded part 5 at right angles to the edge 4A of the upper film 1 in such a manner as to transverse the unbonded part. In addition, a second slit 27 is formed on the periphery of the body seal section 4 at right angles to the edge 4A, and is spaced apart from the unbonded part 5.

A finger or a fingernail is initially inserted into the unbonded part 5, and is moved in an A direction as shown in FIG. 31. As a result of this, the body seal section 4 is separated into an upper film and a lower film, and the edge of the upper film is lifted off from the lower film.

Figure 33:
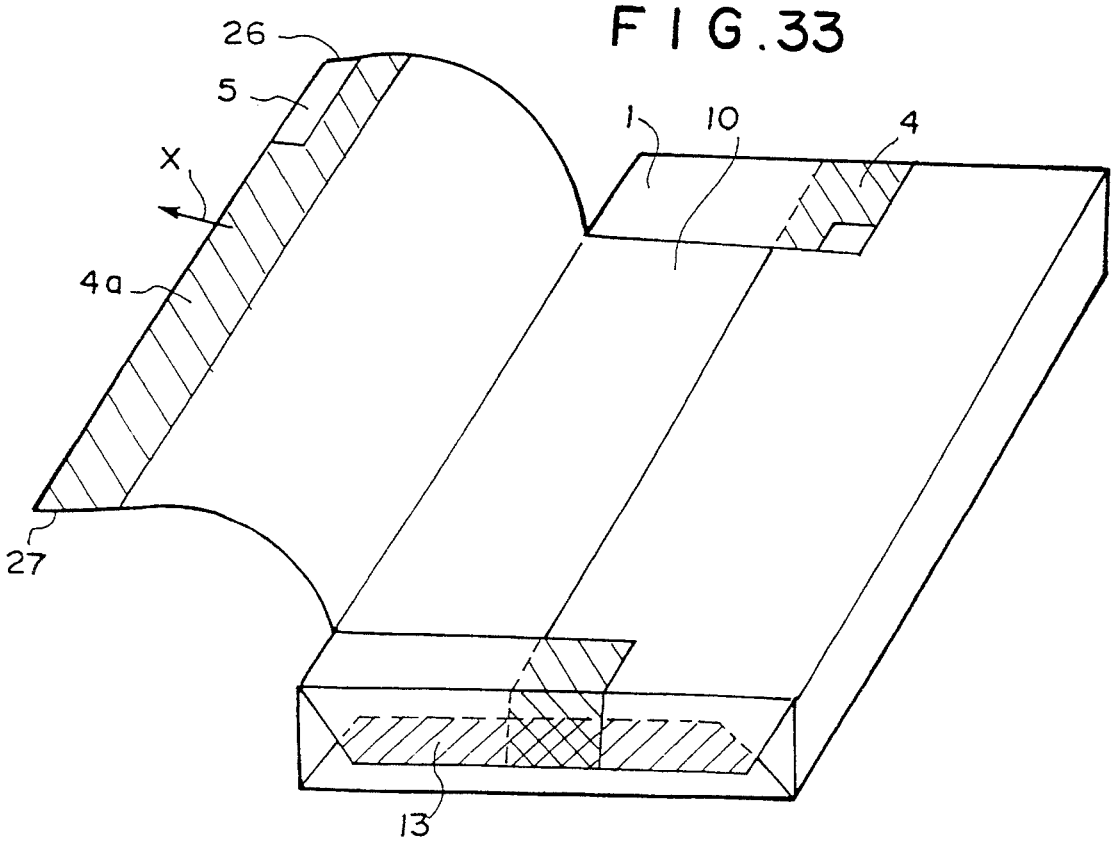
FIG. 33 is a schematic representation of the article shown in FIG. 31 when the upper film is further pulled.

As shown in FIG. 32, the end **4*a* of the exfoliated upper film is peeled off in the X direction, and hence the upper film is detached from the lower film. Then, the film 1 splits along the first and second slits 26 and 27. When the end 4*a* is pulled in the direction X, the split develops from the slits along the imaginary lines 8 and 9, whereby the film 1 opens much wider as shown in FIG. 33**.

The split formed by such a tearing action can continue around the article by a single operation, that is, by peeling off the end **4*a* of the first slit, whereby the film opens much wider. Thereby, the film 1 can be removed in such a way that the entire article 10** will be substantially uncovered in a considerably easy manner.

In addition, the first slit 26 and the second slit 27 are formed in the vicinity of the side seal section 13 of the article 10, and hence the wrapping film at the side seal section can be very easily removed by pulling the remaining film to the outside.

In the case of an existing wrapped article, it is relatively difficult for a user to remove a larger piece of film remaining after the film has been separated by the use of a tearing tape. Compared with this, the wrapped article of this invention enables a very effective removal operation, and also makes the use of the tearing tape unnecessary. This renders the wrapped article very cost effective.

Though the first slit 26 and the second slit 27 may be formed before or after the article 10 is packed, it is desirable for the slits to be made before packaging the article 10, thus removing the risk of damage to the article 10 by a cutting knife, etc.

Eleventh Embodiment

Figure 34:
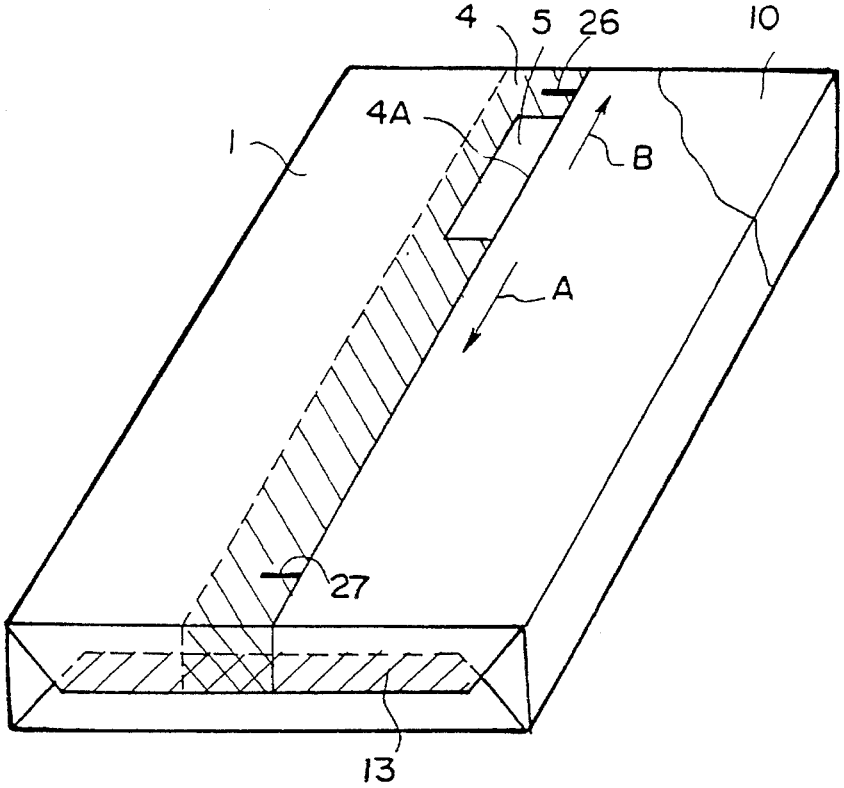
FIG. 34 is a schematic representation of a wrapped article according to an eleventh embodiment of this invention.
Figure 35:
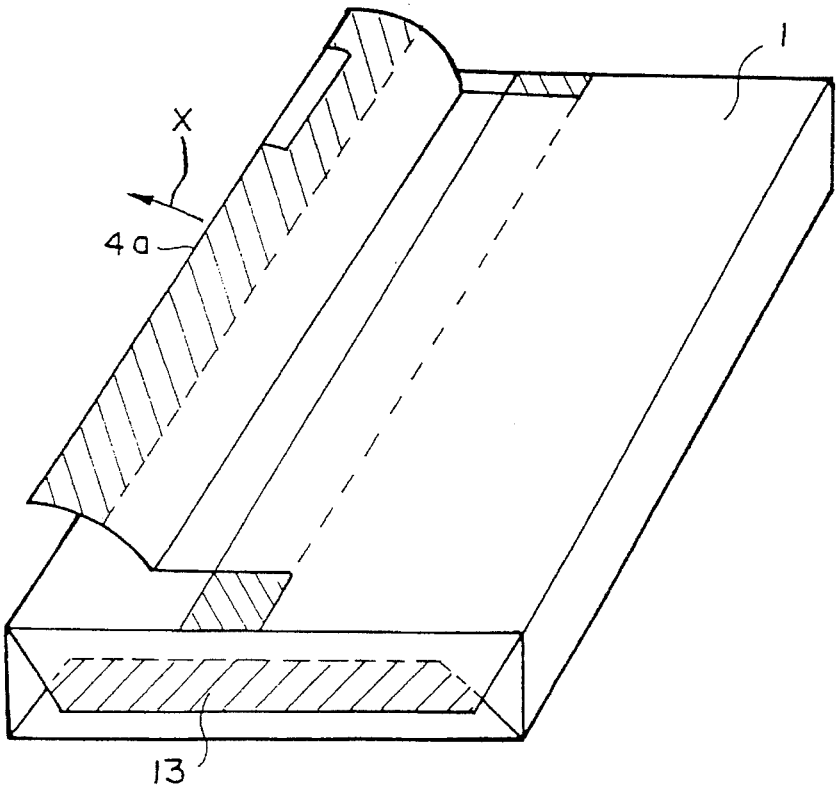
FIG. 35 is a schematic representation of the article shown in FIG. 34 when an upper film of a body seal thereof is raised.

An eleventh embodiment will now be described. FIGS. 34 and 35 show a wrapped article according to this embodiment.

In the drawings, a wrapped state of the wrapping film 1, the unbonded part 5 and the second slit 27 are the same as in the tenth embodiment, and hence detailed descriptions thereof will be omitted. An explanation will only be given of the first slit 26.

In this embodiment, the first slit 26 is formed substantially at right angles to the edge 4A of the upper film, and is positioned on the opposite side relative to the second slit 27 with the unbonded part 5 of the body seal section 4 interposed between them. If this first slit 26 is situated too close to the unbonded part 5, the slit will lap in a packaging process, and hence it is desirable for the slit to be spaced apart from the end of the unbonded part 5 by a few millimeters.

A finger or a fingernail is initially inserted into the unbonded part 5, and is moved in an A direction as shown in FIG. 34. As a result of this, the body seal section 4 is separated into an upper film and a lower film, and the edge of the upper film is lifted off from the lower film.

As shown in FIG. 35, the end **4*a* of the exfoliated upper film is peeled off in the X direction, and hence the upper film is detached from the lower film. Then, the film 1 splits along the first and second slits 26 and 27. When the end 4*a* is pulled in the direction X, the split develops from the slits, whereby the film 1** opens much wider.

The split formed by such a tearing action can continue around the article by peeling off the end **4*a* of the first slit, whereby the film opens much wider. Thus, the film 1 can be removed in such a way that the entire article 10** will be substantially uncovered in a considerably easy manner.

In addition, the first slit 26 and the second slit 27 are formed in the vicinity of the side seal section 13 of the article 10, and hence the wrapping film at the side seal section can be very easily removed by pulling the remaining film outside.

Twelfth Embodiment

Figure 36:
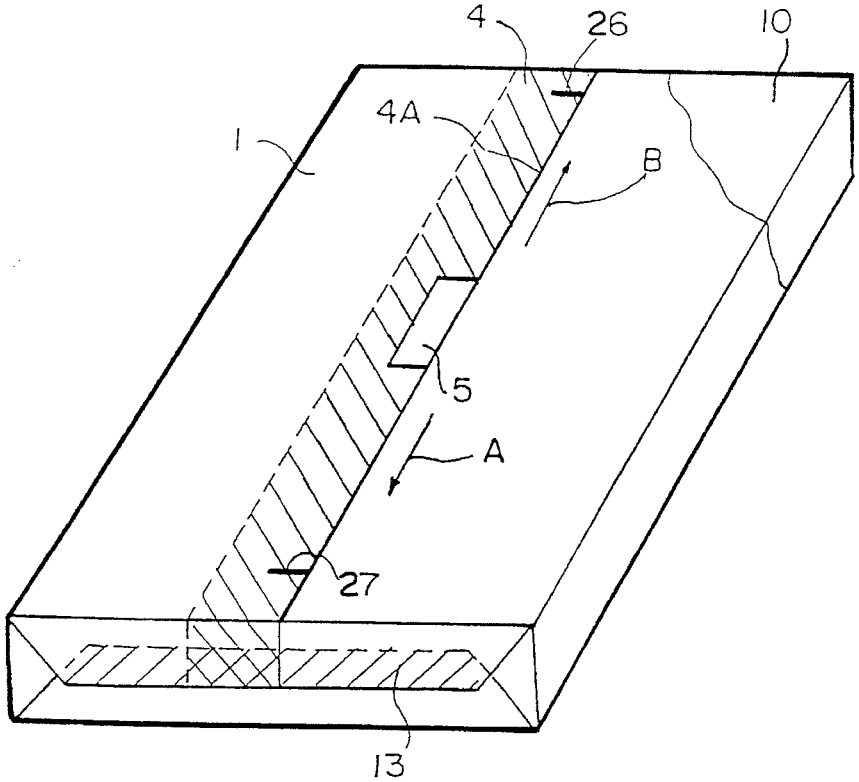
FIG. 36 is a schematic representation of a wrapped article according to a twelfth embodiment of this invention.

A twelfth embodiment will now be described. FIG. 36 shows a wrapped article according to this embodiment. In this embodiment, the unbonded part 5 mentioned in the eleventh embodiment is positioned substantially at the middle between the first slit 26 and the second slit 27 in the body seal section 4.

As shown in FIG. 36, a finger or a fingernail is initially inserted into the unbonded part 5, and is moved in both A and B directions in the same manner as in the eleventh embodiment. As a result of this, the body seal section 4 is separated into an upper film and a lower film, and the edge of the upper film is lifted off from the lower film.

As with the eleventh embodiment, the end **4*a* of the exfoliated upper film is peeled off in the X direction, and hence the upper film is detached from the lower film. Then, the film 1 splits along the first and second slits 26 and 27. When the end 4*a* is further pulled in the direction X, the split develops from the slits, whereby the film 1 opens much wider. Thus, the entire article 10 can be quite easily removed. In addition, the first slit 26 and the second slit 27 are formed in the vicinity of the side seal section 13 of the article 10**, and hence the wrapping film at the side seal section can be very easily removed by pulling the remaining film to the outside.

Thirteenth Embodiment

Figure 37:
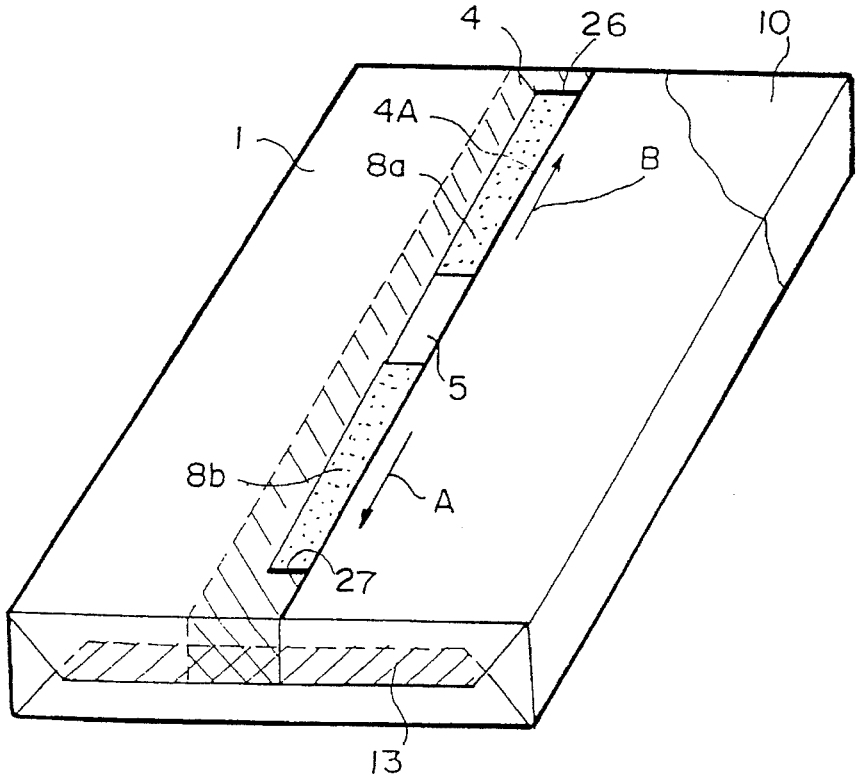
FIG. 37 is a schematic representation of a wrapped article according to a thirteenth embodiment of this invention.
Figure 38:
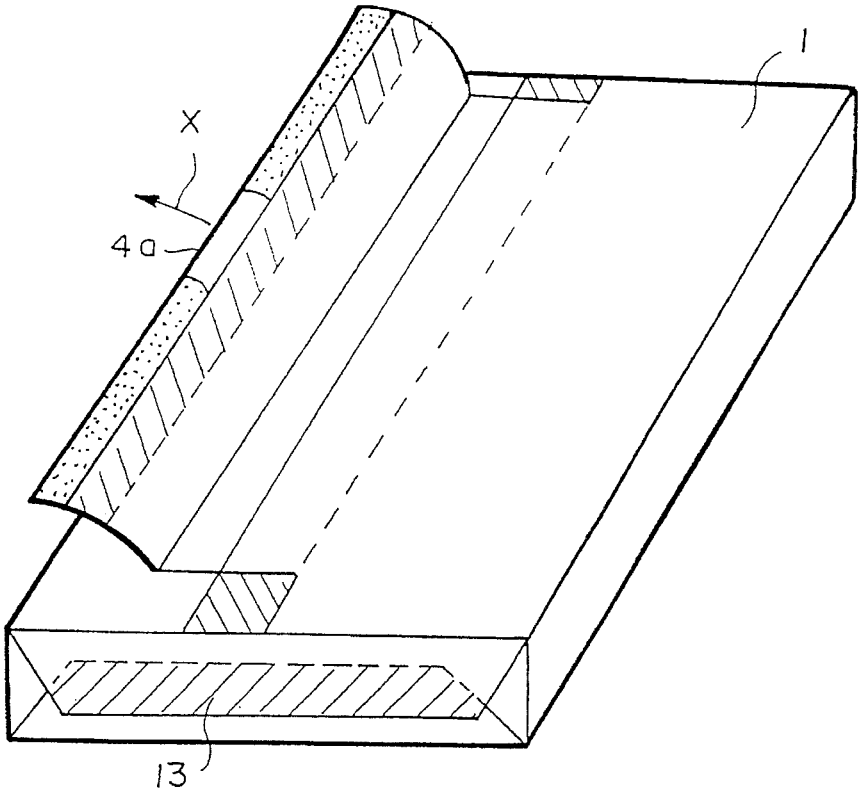
FIG. 38 is a schematic representation of the article shown in FIG. 37 when an upper film of a body seal thereof is raised.

A thirteenth embodiment will now be described. FIGS. 37 and 38 show a wrapped article according to this embodiment. In the drawings, a wrapped state of the wrapping film 1, the unbonded part 5, the first slit 26 and the second slit 27 are the same as in the twelfth embodiment. In this embodiment, however, a weakly bonded part 18*a* is formed along the periphery of the body seal section 4 that is closer to the edge of the upper film between first slit 26 and the corresponding end of the unbonded part 5, and a weakly bonded part 18*b* is formed on the same periphery of the body seal section between the second slit 27 and the corresponding end of the unbonded part 5. At these bonded parts 18*a* and 18*b*, the upper film and the lower film are weakly bonded together.

In these weakly bonded parts 18*a* and 18*b*, the rear of the film 1 in the area corresponding to these parts is printed with a dot or stripe pattern. When the body seal section 4 is bonded by heating, the presence of the dot or stripe pattern print prevents the body seal section 4 from being entirely welded. Alternatively, the weakly bonded parts 18*a* and 18*b* can be produced by printing that area in the film 1 in ink having a weak blocking tendency.

When the film is printed with a dot or stripe pattern, a ratio of a printed area to an unprinted area should preferably be set to 6 to 4 or thereabouts.

A finger or a fingernail is initially inserted into the unbonded part 5, and is moved in both A and B directions as shown in FIG. 37. As a result of this, the weakly bonded parts 18*a* and 18*b* in the body seal section 4 are separated into an upper film and a lower film, and the edge of the upper film is lifted off from the lower film.

As shown in FIG. 38, the end 4*a* of the exfoliated upper film is peeled off in the X direction, and hence the upper film is detached from the lower film. Then, the film 1 splits along the first and second slits 26 and 27. When the end 4*a* is further pulled in the direction X, the split develops from the slits, whereby the film 1 opens much wider. Thus, the entire article 10 can be quite easily removed.

The split formed by such a tearing action can continue around the article by peeling off the end 4*a* of the first slit, whereby the film opens much wider. Thus, the film 1 can be removed in such a way that the entire article 10 will be substantially uncovered in a considerably easy manner.

Fourteenth Embodiment

Figure 39:
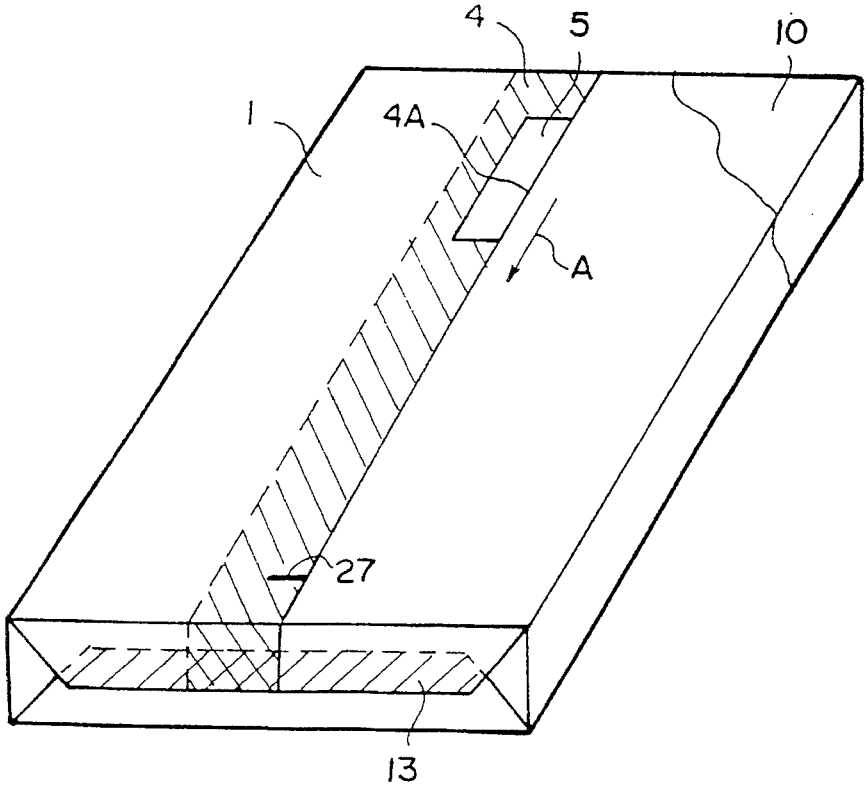
FIG. 39 is a schematic representation of a wrapped article according to a fourteenth embodiment of this invention.
Figure 40:
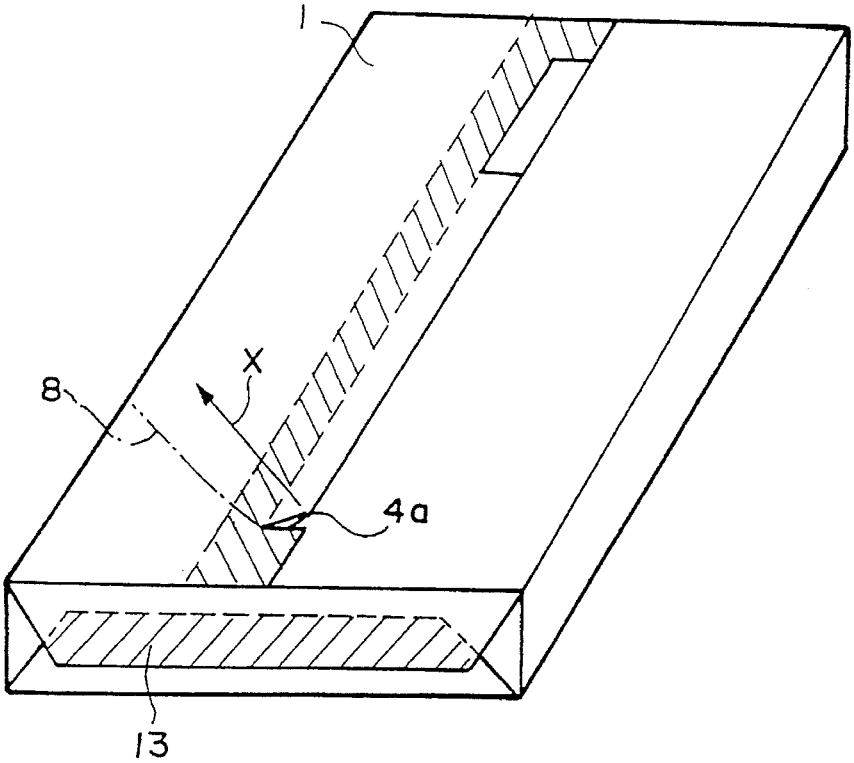
FIG. 40 is a schematic representation of the article shown in FIG. 39 when an upper film of a body seal thereof is raised.

A fourteenth embodiment will now be described. FIGS. 39 and 40 show a wrapped article according to this embodiment. In the drawings, a wrapped state of the wrapping film 1 and the unbonded part 5 are the same as in the tenth and eleventh embodiments. However, in this embodiment, the first slit 26 is not formed, but only the second slit 27 is formed.

In the same way as in the tenth and eleventh embodiments, a finger or a fingernail is initially inserted into the unbonded part 5, and is moved in an A direction. As a result of this, the body seal section 4 is separated into an upper film and a lower film, and the edge of the upper film is lifted off from the lower film.

Figure 41:
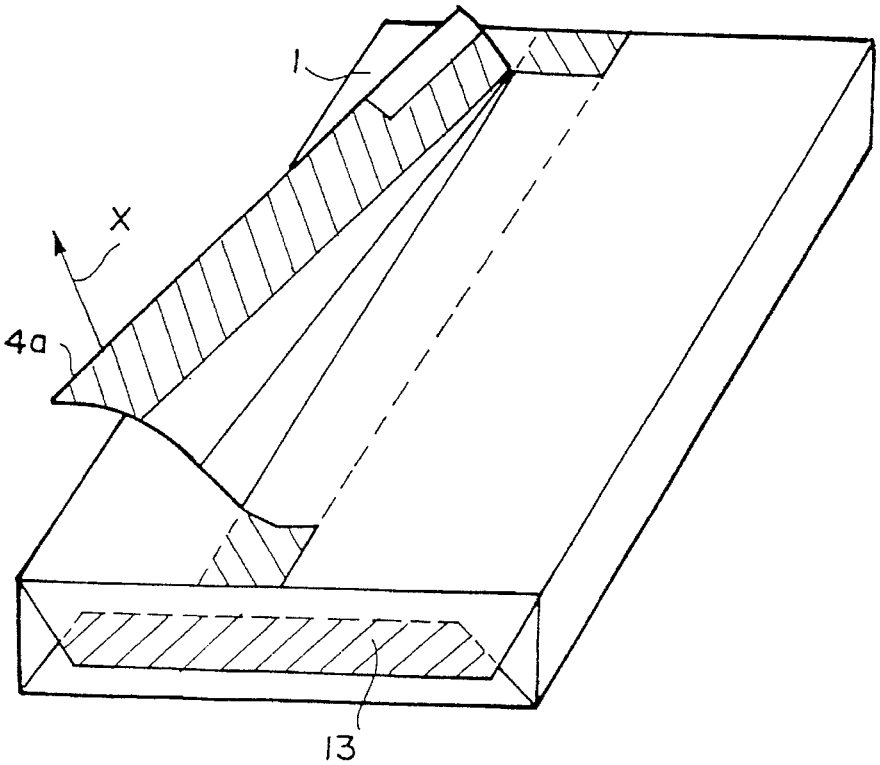
FIG. 41 is a schematic representation of the article shown in FIG. 39 when the film is further pulled.

As shown in FIG. 44, the end 4*a* of the exfoliated upper film is peeled off in the X direction, and hence the upper film is detached from the lower film. Then, the film 1 splits along the first and second slits 26 and 27. Differing from the tenth and eleventh embodiments, the first slit is not formed in this embodiment. The end 4*a* should preferably be peeled off in an inclined direction relative to the edge 4A of the upper film. When the end 4*a* is further pulled in the direction X, the split develops from the slits along the imaginary line 8 shown in the drawing, whereby the film 1 opens much wider as shown in FIG. 41.

The split formed by such a tearing action can continue around the article by peeling off the end 4*a* of the first slit, whereby the film opens much wider. Thus, the film 1 can be removed in such a way that the entire article 10 will be substantially uncovered in a considerably easy manner in the same way as in the tenth and eleventh embodiments.

Fifteenth Embodiment

A fifteenth embodiment will now be described. FIG. 42 shows a wrapped article according to this embodiment. In the drawings, a wrapped state of the wrapping film 1, the unbonded part 5, and the second slit 27 are the same as in the fourteenth embodiment. However, in this embodiment, a weakly bonded part 18*c* similar to that in the thirteenth embodiment is formed between the second slit 27 and the corresponding end of the unbonded part 5.

In the same way as in the fourteenth embodiment, a finger or a fingernail is initially inserted into the unbonded part 5, and is moved in an A direction as shown in FIG. 42. As a result of this, the weakly bonded part 8*c* in the body seal section 4 is separated into an upper film and a lower film, and the edge of the upper film is lifted off from the lower film.

As with the fourteenth embodiment, the end 4*a* of the exfoliated upper film is peeled off in the X direction, and hence the upper film is detached from the lower film. Then, the film 1 splits along the second slit 27.

The split formed by such a tearing action can continue around the article by peeling off the end 4*a* of the first slit, whereby the film opens much wider. Thus, the film 1 can be removed in such a way that the entire article 10 will be substantially uncovered in a considerably easy manner in the same way as in the tenth and fourteenth embodiments.

Sixteenth Embodiment

A sixteenth embodiment will now be described. FIG. 43 shows a wrapped article according to this embodiment, in which an audio cassette is enclosed, as an article to be wrapped, in a wrapping film. As shown in the drawing, in the same manner as in the third, fourth and ninth embodiments, both ends of the wrapping film 1 overlap with each other substantially at the center of a narrow lateral surface of an audio cassette 11 (the cassette is housed in a case) which serves as the article, and heated and lap-welded together to constitute the body seal section 4. Both ends of the body seal section 4 are lap-welded together with the longitudinal overlapping edges of the film 1, thereby constituting the side seal section 13. In the body seal section 4, in the same way as in the tenth embodiment, the unbonded part 5, the first slit 26 and the second slit 27 are formed.

Like this, since the unbonded part 5, the first slit 26 and the second slit 27 are formed in the body seal section 4, the film 1 of this embodiment splits in the same way as it does in the tenth embodiment, and hence the film 1 can be very easily removed.

In this embodiment, though the unbonded part, the first slit and the second slit similar to those in the tenth embodiment are provided, the unbonded part, the first slit, the second slit, or the weakly bonded part similar to that in the eleventh to fifteenth embodiments may be provided.

In the tenth to the sixteenth embodiments, the first slit or the second slit is formed substantially at right angles to the edge of the body seal section. However, the first slit 26 or the second slit 27 may be formed at an inclined angle to the edge of the body seal section 4 as shown in FIG. 44.

In the previous embodiments, the first slit is linearly formed. However, as shown in FIG. 45, the first slit 26 or the second slit may be V-shaped, thereby facilitating the peeling of the first slit 26 or the second slit 27 with fingers. The shape of these first and second slits can be applied to the eleventh, twelfth and thirteenth embodiments set forth above.

Figure 46:
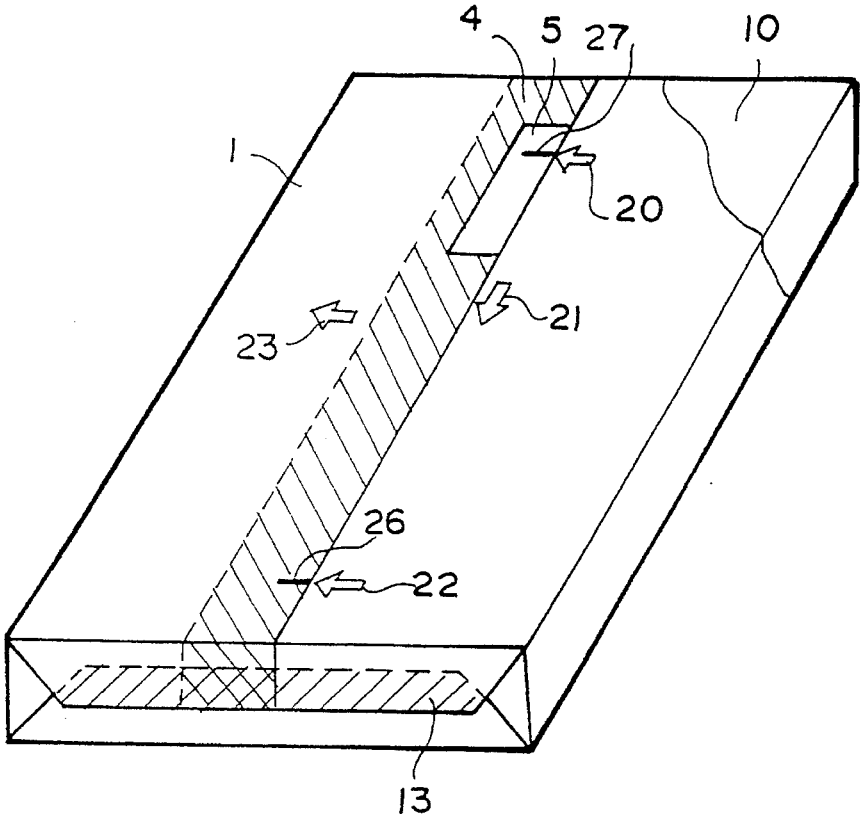
FIG. 46 is a schematic representation showing the wrapped article in the tenth to the sixteenth embodiments when an unbonded portion, and the first and second slits of the article are provided with a mark.
Figure 47:
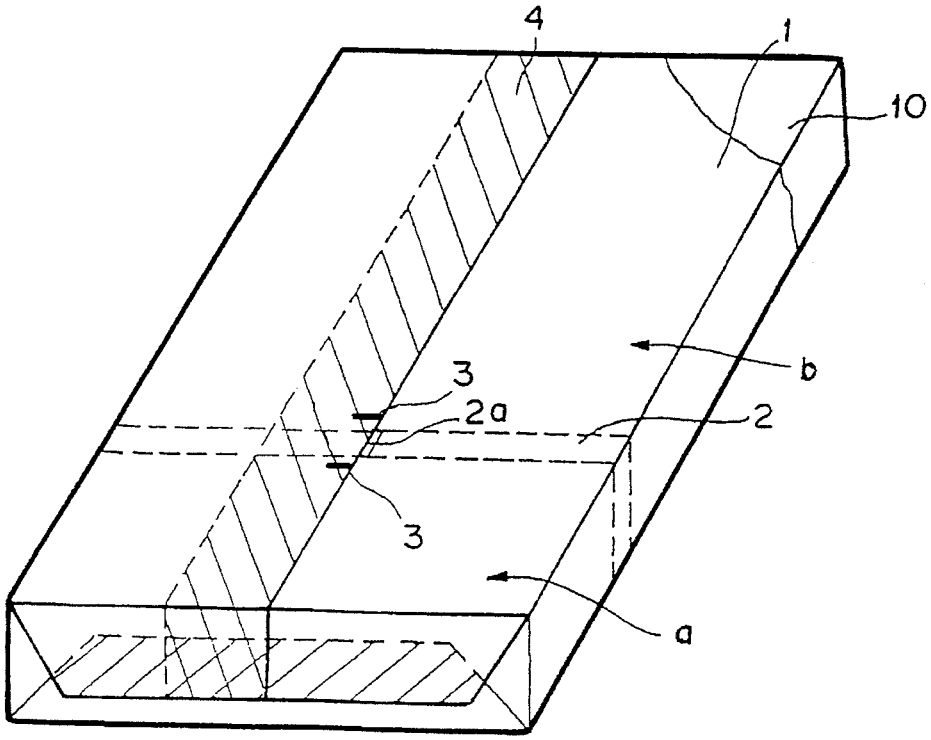
FIG.47 PRIOR ART
FIG. 47 is a schematic representation showing a conventional wrapped article.

Moreover, in order to make, the position of the unbonded part, the first slit and the second slit and a peeling direction of the slits distinctive, the wrapping film may be provided with marks 20, 21, 22 and 23, for example, an arrow as shown in FIG. 46.

In order to make the position of the unbonded part noticeable, the unbonded part of the film may be made different in color from the other portion.

In the tenth to sixteenth embodiments, parallelepiped-shaped articles such as the video cassette and the audio cassette are used as the article to be wrapped. However, the article is not limited to them. The article according to this invention can be applied to articles in any shapes such as a sphere, a rectangular parallelepiped, a cylinder, or a circular cone, so long as they can be enclosed with a wrapping film.

Several embodiments of the invention have now been described in detail. It is to be noted, however, that these descriptions of specific embodiments are merely illustrative of the principles underlying the inventive concept. It is contemplated that various modifications of the disclosed embodiments, as well as other embodiments of the invention will, without departing from the spirit and scope of the invention, be apparent to those who are versed in the art.

What is claimed is:

1. An article is covered with a wrapping film, and a body seal section is made by making both ends of the wrapping film overlap with each other and bonding them together, the improvement comprising:

a first slit formed, substantially parallel to both the edge of a lower section of film and the body seal section, on the edge of an upper section of the film which is in the body seal section; and a second slit formed on the periphery of the lower section of the film at a right angle to the first slit in such a manner as to traverse the body seal section.

2. An article as defined in claim 1, wherein the second slit is formed in the vicinity of the first slit.

3. A wrapped article as defined in claim 1, wherein two second slits are formed and spaced apart from each other with the first slit positioned between them.

4. A wrapped article in which the outer surface is covered with a wrapping film and a body seal section is formed by making both ends of the wrapping film overlap with each other and bonding them together while the longitudinal periphery of the body seal section closer to the edge of a lower film is kept unbonded, the improvement comprising:

a first slit formed substantially parallel to the edge of the lower film portion in the unbonded periphery of the body seal section; and at least one second slit formed on the periphery of the lower film portion in the bonded portion of the body seal section at an angle to the first slit in such a manner as to traverse the body seal section.

5. A wrapped article as defined in claim 4, wherein the second slit is formed in the vicinity of the periphery of the first slit substantially at right angles to the first slit.

6. A wrapped article as defined in claim 4, wherein two second slits are formed and spaced apart from each other with the first slit positioned between them.

7. A wrapped article in which the outer surface is covered with a wrapping film and a body seal section is made by making both ends of the wrapping film overlap with each other and bonding them together, the improvement comprising:

an unbonded part, where an upper film and a lower film are not bonded together, formed in the body seal section in such a manner that the unbonded part covers at least a part of the edge of the upper film and does not transversely extend to the edge of the lower film;

a first slit formed in the unbonded-part at an angle to the edge of the unbonded part in such a manner as to transverse the unbonded part; and a second slit formed in the lower film in the body seal section, and having a second slit starting portion extending to the inside of the body seal from an initial point on the edge of the lower film and an extended portion that continually extends from the second slit starting portion in a direction moving away from the first slit, in which the second slit is formed in such a way that the second slit starting portion and the extended portion extend away from each other in relation to the first slit.

8. A wrapped article as defined in claim 7, wherein the article has at least two surfaces; the body seal section is formed substantially at the center of one of the surfaces of the article; the first slit is formed in the vicinity of the periphery of the body seal; and the extended portion of the second slit extends to the inside of said surface.

9. A wrapped article as defined in claim 7, wherein the first slit is provided with a mark to make said first slit distinctive and to indicate a peeling direction thereof.

10. A wrapped article as defined in claim 8, wherein the first slit is provided with a mark to make said first slit distinctive and to indicate a peeling direction thereof.

11. An article is covered with a wrapping film, and a body seal section is made by making both ends of the wrapping film overlap with each other and bonding them together, the improvement comprising:

a first slit formed, substantially parallel to the edge of a lower section of film, on the edge of an upper section of the film which is in the body seal section; and a second slit formed on the periphery of the lower section of the film at an inclined angle to the first slit in such a manner as to traverse the body seal section.

12. An article as defined in claim 11, wherein the second slit is formed in the vicinity of the first slit.

13. An article is covered with a wrapping film, and a body seal section is made by making both ends of the wrapping film overlap with each other and bonding them together, the improvement comprising:

a first slit formed, substantially parallel to the edge of a lower section of film, on the edge of an upper section of the film which is in the body seal section; and a second slit formed on the periphery of the lower section of the film at a right angle to the first slit in such a manner as to traverse the body seal section;

wherein the second slit is formed in the vicinity of the first slit.

14. An article is covered with a wrapping film, and a body seal section is made by making both ends of the wrapping film overlap with each other and bonding them together, the improvement comprising:

a first slit formed, substantially parallel to the edge of a lower section of film and the body seal section, at a position spaced away from the edge of the upper section of the film; and a second slit formed on the periphery of the lower section of the film at a right angle to the first slit in such a manner as to traverse the body seal section.

15. An article as defined in claim 14, wherein the second slit is formed in the vicinity of the first slit.

16. An article is covered with a wrapping film, and a body seal section is made by making both ends of the wrapping film overlap with each other and bonding them together, the improvement comprising:

a first slit formed, substantially parallel to the edge of a lower section of film and the body seal section, at a position spaced away from the edge of the upper section of the film; and a second slit formed on the periphery of the lower section of the film at an inclined angle to the first slit in such a manner as to traverse the body seal section.

17. An article as defined in claim 16, wherein the second slit is formed in the vicinity of the first slit.

* * * * *